US008613225B2

(12) United States Patent
Fujii et al.

(10) Patent No.: US 8,613,225 B2
(45) Date of Patent: Dec. 24, 2013

(54) DEVICE FOR INSPECTING FRONT AND BACK SURFACES OF A STRIP MATERIAL AND METHOD THEREOF

(75) Inventors: Motoyuki Fujii, Hiroshima (JP); Hisayoshi Ishii, Hiroshima (JP); Hironori Shimogama, Tokyo (JP); Mitsuru Onose, Tokyo (JP)

(73) Assignee: Mitsubishi-Hitachi Metals Machinery, Inc., Tokyo (JP)

( * ) Notice: Subject to any disclaimer, the term of this patent is extended or adjusted under 35 U.S.C. 154(b) by 538 days.

(21) Appl. No.: 12/740,665

(22) PCT Filed: Oct. 17, 2008

(86) PCT No.: PCT/JP2008/068840

§ 371 (c)(1),
(2), (4) Date: Apr. 29, 2010

(87) PCT Pub. No.: WO2010/044165

PCT Pub. Date: Apr. 22, 2010

(65) Prior Publication Data

US 2010/0257939 A1 Oct. 14, 2010

(51) Int. Cl.
*G01N 3/08* (2006.01)

(52) U.S. Cl.
USPC ..... 73/831

(58) Field of Classification Search
USPC ..... 73/831, 865.8
See application file for complete search history.

(56) References Cited

U.S. PATENT DOCUMENTS 2,023,904 A * 12/1935 Schulte ..... 29/17.2
3,461,718 A * 8/1969 Harvey et al. ..... 73/806

(Continued)

FOREIGN PATENT DOCUMENTS

CN 1747802 A 3/2006
CN 101084076 A 12/2007

(Continued)

OTHER PUBLICATIONS

Chinese Office Action from corresponding Chinese Application No. 200880114362.6 dated Novemer 26, 2012 with English translation.

*Primary Examiner* — Lisa Caputo
*Assistant Examiner* — Octavia D. Hollington
(74) *Attorney, Agent, or Firm* — Birch, Stewart, Kolasch & Birch, LLP.

(57) ABSTRACT

In an inspection device for inspecting front and back surfaces of a strip material rolled by a rolling machine, both ends of the strip material along a longitudinal direction of the strip material are claimed by two pairs of clamping devices and the front surface of the back surface of the strip material is pressed at an optional position between the two pairs of the clamping devices by at least one pressing device. Thus, after clamping the strip material, the two pairs of the clamping devices are not displaced along the longitudinal direction of the strip material. A function for applying tensile stress to the strip material and a function for clamping the strip material are individually and separately provided so that the inspection device can be simplified. By pressing the strip material at a point between the two pairs of the clamping devices, at least one of pressing devices can be down sized. It is superior in view of an economical reason. It is possible to set tensile stress at high accuracy and minimize tensile stress variation with respect to a tensile stress level previously set in an operation for inspecting front and back surfaces of the strip material. Therefore, it can be reduced a risk that the strip material is broken and it can be provide a safety inspection device with high reliability for inspecting front and back surfaces of the strip material. Further, it is possible to provide an inspection device for inspecting front and back surfaces wherein a warp of the strip material along a width direction thereof can be adjusted and wrinkles occurred on the strip material by clamping with the clamping devices are controlled.

13 Claims, 14 Drawing Sheets

(56) References Cited

U.S. PATENT DOCUMENTS

| | | | | |
|---|---|---|---|---|
| 6,439,022 | B1 * | 8/2002 | Kamada et al. | 72/302 |
| 7,654,161 | B2 | 2/2010 | Rossigneux | |
| 7,766,149 | B2 | 8/2010 | Tiepelmann et al. | |
| 7,980,109 | B2 * | 7/2011 | Perret | 72/229 |
| 2004/0174518 | A1 * | 9/2004 | Naiki et al. | 356/237.2 |
| 2006/0236511 | A1 | 10/2006 | Tiepelmann et al. | |
| 2007/0295881 | A1 | 12/2007 | Rossigneux | |

FOREIGN PATENT DOCUMENTS

| | | | |
|---|---|---|---|
| JP | 59-113916 | A | 6/1984 |
| JP | 2006-516484 | A | 7/2006 |
| JP | 2008-519693 | A | 6/2008 |
| WO | WO 2004/069441 | A1 | 8/2004 |
| WO | WO 2006/051239 | A1 | 5/2006 |

* cited by examiner

DEVICE FOR INSPECTING FRONT AND BACK SURFACES OF A STRIP MATERIAL AND METHOD THEREOF

FIELD OF THE INVENTION

The present invention relates to a device for inspecting front and back surfaces of a strip material and a method thereof.

BACKGROUND OF THE INVENTION

In a case of cool rolling a strip material, the strip material is continuously pressed by a pair of an upper working roll and a lower working roll of a rolling machine. Due to a plastic process operation, a surface condition of the upper working roll and a surface of the lower working roll is transferred onto the front and back surfaces of the strip material, respectively. If a working roll having a defect, a crack or a chip is rolled, a harmful defect and/or design/pattern is marked on a strip material finally produced along a whole length of a coil of the strip material by synchronizing with a rotation of the upper and lower working rolls.

In the case that any defects or designs are transferred onto front and back surfaces of the rolled strip material, these defects or designs cannot be removed/disappeared even if any process is operated after rolling a produced strip material with the working roller having a defeat once in the rolling step. Such a phenomenon is a reason why a product yield is so reduced.

Thus, in order to detect a defect or a design appeared as a geometric pattern existing on front and back surfaces of a strip material, it is necessary to inspect the produced strip material periodically. In order to find out a specific rolling stand of a tandem-type cool rolling apparatus of which a working roll has a defect on its surface after finding such a defect after a pitch, a rolled strip material having a length of several meters to 15 meters is cut-out and front and back surfaces of a cut-out strip material is optically inspected.

In a general inspection method for detecting a geometric defect/pattern, the method includes a honing process, that is, the front and back surfaces of a strip material are grinded with a whetstone so as to emphasize the defects on the front and back surfaces of the rolled strip material.

Alternatively, there are other inspection methods. One is an in-line inspection method for cutting-out a strip material immediately after rolling and detecting the strip material by an inspection device arranged at a downstream side with respect to a rolling apparatus. Another is an on-line inspection method for winding up a rolled strip material, carrying out such a coil shaped strip material to an inspection device, winding out a rolled strip material and cutting out the rolled strip.

During the honing process in the inspection method, if the honing process is applied on an upper surface of the strip material stacked on an inspection table, a new defect or a design is provided on a lower surface of the strip material contacted with the inspection table due to the honing operation. It is impossible to distinguish the new defect or the new design provided in the honing process and the defect or the design provided in the rolling operation. In order to resolve such a subject, it had been disclosed an inspection method for honing a strip material without contacting the strip material with an inspection table by providing a tensile stress producing device (tensile station) at an optional position of two pairs of clamping devices. [Patent Document 1]

Alternatively, it had been disclosed an inspection method for separating two pairs of clamping devices so as to produce a tensile stress with respect to a strip material and rotating the strip material at 180 degree so as to inspect front and back surfaces of a rolled strip material. [Patent Document 2]

Patent Document 1:

Japanese Patent Publication 2006-516484 (WO2004/069441)

Patent Document 2:

Japanese Patent Publication 2008-519693 (WO2006/051239)

DISCLOSURE OF THE INVENTION

Subject to be Solved by the Invention

In the Patent Document 1 mentioned above, there is a problem. That is, while a strip material and an inspection table are maintained in a non-contact condition during honing process by providing a tensile stress producing device (tensile station) with two pairs of clamping devices provided at optional positions, an inspection method can only operate an honing process and inspect an upper surface of the strip material.

In the Patent Document 2 mentioned above, there is a problem. That is, two pairs of clamping devices are separated and a strip material is rotated at 180 degree while a tensile stress is applied to the strip material. It is required for the two pairs of the clamping devices to provide two functions, that is, a separating function and a rotating function so that a size of an inspection device becomes large.

In the inspection device, a strength of a tensile stress produced in the strip material is determined by a separated distance between two pairs of the clamping devices. For example, a tensile stress of about 20 $N/mm^2$ is produced by elongating a distance of 1 mm between the clamping devices of 10 g. In general, a strip tensile stress is set within a range from 10 $N/mm^2$ to 50 $N/mm^2$ in accordance with a thickness of the strip material, while the strip material is inspected. It means that a separated distance between the clamping devices is from 0.5 mm to 2.5 mm. When an inspector applies a honing process to the strip material, an inspector approaches a position where is very near the strip material. Therefore, a set tensile stress with respect to the strip material becomes too large. It has to prevent for the strip material from being broken. Accordingly, although a tensile stress applied to a strip material with a high accuracy, a positioning accuracy for separating two pairs of clamping devices is about 0.1 mm, that is, a tensile stress displacement amount is about 2 $N/mm^2$. In order to maintain an accuracy of 0.1 mm in a double layered structure wherein the clamping devices have to include the separating function and the rotating function together, a lot of parts having high accuracy have to be employed and a rigidity thereof has to be increased. In the case that a machinery system is deteriorated after using for a long time, it becomes difficult to maintain a set tensile stress with a required high accuracy. A strip material is slack and clamping devices are manually moved so as to adjust such a slack. Then, a tensile stress is set too large in a honing inspection step and a risk that a strip material is broken is increased. It is a serious problem in view of a safety.

In the inspection device for applying a tensile stress to a strip material by arranging two pairs of clamping devices separately, it is necessary to provide a separating machine capable of outputting a power force as same as the tensile stress. A size of the inspection device has to be large.

In the case that a separated distance between the two pairs of the clamping devices is long, even if an inspected strip material has a warp along the width direction thereof, it could not be adjusted a warp of a strip material along the width direction of the strip material. Such a situation sometimes provides a baneful influence to inspect the strip material optically.

Further, in a conventional inspection device, during carrying out an inspected strip material, a front end portion of the strip material is sticking against a rear end portion of an inspection table so that the inspected strip material could not be passed away.

In the case that a strip material of which a length is from several meters to 15 meters is clamped by clamping devices, it is apt to occur wrinkles on front and back surfaces of the strip material beginning from a point clamped by the clamping devices. Due to a luster variation caused by such wrinkles, an operation for judging whether any defects or designs are existed is banefully influenced.

A subject of the present invention is to provide an inspection device for inspecting front and back surfaces of a strip material which is economically superior by simplifying a structure thereof and down sizing a pressing device.

Further, a tensile stress can be set with a high accuracy so that a tensile stress variation can be minimized with respect to a tensile stress set in an inspection step for inspecting the front and back surfaces of the strip material. Thus, it becomes possible to provide a safety and high accurate inspection device for inspecting front and back surfaces of a strip material by reducing a risk that the strip material is broken.

Another subject of the present invention is to provide an inspection device for inspecting front and back surfaces of a strip material of which a reliability is improved at a step for carrying out the inspected strip material.

Another subject of the present invention is to provide an inspection device for inspecting front and back surfaces of a strip material wherein a warp of the strip material along a width direction thereof can be adjusted and wrinkles occurred from points of the strip material clamped by clamping the strip material.

Means to Solve the Subject

To resolve the above subject, in an inspection device according to the first present invention, an inspection device for inspecting a front surface and a back surface of a strip material rolled by a rolling machine is characterized of comprising two pairs of clamping devices for clamping the both ends of the strip material along a longitudinal direction of the strip material, respectively and at least two pressing devices for pressing the front surface or the back surface of the strip material at optional positions between the two pairs of the clamping devices.

To resolve the above subject, in the inspection device according to the first present invention, the inspection device according to the second invention is characterized in that the two pairs of the clamping devices are rotated at an optional angular degree around a central point of the strip material along a width direction of the strip material or a point near the central point as a rotational axis and at least the two pressing devices is arranged at optional positions between the two pairs of the clamping devices, respectively and presses the front surface or the back surface of the strip material rotated at the optional angular degree by the clamping devices.

In order to resolve the above subject, in an inspection device according to the third present invention, an inspection device for inspecting a front surface and a back surface of a strip material rolled by a rolling machine is characterized of comprising two pairs of clamping devices for clamping the both ends of the strip material along a longitudinal direction of the strip material, respectively and at least one pressing device for pressing the front surface or the back surface of the strip material at optional positions between the two pairs of the clamping devices.

In order to resolve the above subject, in an inspection device according to the second or third present invention, an inspection device according to the fourth present invention is characterized in that the clamping devices and the pressing device(s) are attached to rotational frames for rotating the strip material around a central point of the strip material along the width direction or a point near the central point as an rotational axis at an optional angular degree, respectively.

In order to resolve the above subject, in the inspection device for inspecting a front surface and a back surface of a strip material according to one of the first present invention through the fourth present invention, the inspection device according to the fifth present invention is characterized of comprising a strip material conveying device between the two pairs of the clamping devices and the strip material conveying device for conveying the strip material along the longitudinal direction at a level that the strip material are clamped by the two pairs of the clamping devices.

In order to resolve the above subject, in the inspection device for inspecting a front surface and a back surface of a strip material according to the fifth present invention, the inspection device according to the sixth present invention is characterized in that the strip material conveying device is vertically movable.

In order to resolve the above subject, in the inspection device for inspecting front surface and a back surface of a strip material according to one of the first present invention through the sixth present invention, the inspection device according to the seventh present invention is characterized in that at least one of the two pair of the clamping devices comprise a tensile stress measurement device and a control device for controlling a pressing amount of the pressing device (s) so as to equal a tensile stress measured by the tensile stress measurement device to a tensile stress previously set.

In order to resolve the above subject, in the inspection device for inspecting front surface and a back surface of a strip material according to one of the first present invention through the seventh present invention, the inspection device according to the eighth present invention is characterized in that the pressing device is arranged at an outlet side with respect to the two pairs of the clamping devices for clamping the strip material between that the strip material is conveyed and the pressing device applied a desirable warped shape with respect to the front end of the strip material.

In order to resolve the above subject, in the inspection device for inspecting front surface and a back surface of a strip material according to one of the first present invention through the eighth present invention, the inspection device according to the ninth present invention is characterized of comprising a tensile stress producing device for applying tensile stress to the strip material of which the both ends along the longitudinal direction are clamped by the two pairs of the clamping devices.

In order to resolve the above subject, in a inspection method for inspecting a front surface and a back surface of a strip material rolled by a rolling machine, the inspection method according to the tenth present invention is characterized of comprising: pressing the front surface of the strip material by at least two pressing devices, wherein both ends of the strip material are clamped by two pairs of clamping devices and at least the two pressing devices are provided at optional positions between the two pairs of the clamping devices and inspecting the front surface or the back surface of the strip material, respectively.

In order to resolve the above subject, in the inspection method for inspecting a front surface and a back surface of a strip material according to the tenth present invention, the inspection method according to the eleventh present invention is characterized of comprising turning the strip material clamped by the two pairs of the clamping devices around a center point of the strip material along with a width direction of the strip material or a point near the center point as an rotational axis at an optional angular degree, pressing the front surface of the back surface of the strip material turned and hold at the optional angular angle by at least the two pressing device so as to inspect the front surface or the back surface of the strip material.

In order to resolve the above subject, in the inspection method for inspecting a front surface and a back surface of a strip material rolled by a rolling machine, the inspection method according to the twelfth present invention is characterized of comprising pressing the front surface of the strip material by at least one pressing device, wherein both ends of the strip material are clamped by two pairs of clamping devices and at least the one pressing device is provided at an optional position between the two pairs of the clamping devices and inspecting the front surface or the back surface of the strip material and turning the strip material around a central point of the strip material along a width direction or a point near the central point as an rotational axis at an optional angular axis so as to inspect the front surface or the back surface of the strip material.

In order to resolve the above subject, in the inspection method for inspecting a front surface and a back surface of a strip material according to one of the tenth present invention through the twelfth present invention, the inspection method according to the thirteenth present invention is characterized of conveying the strip material along the longitudinal direction, wherein a strip conveying device is arranged between the two pairs of the clamping devices and the strip material is conveyed at a height as same as a level of the strip material clamped by the clamping devices.

In order to resolve the above subject, in the inspection method for inspecting a front surface and a back surface of a strip material according to the thirteenth present invention, the inspection method according to the fourteenth present invention is characterized of turning the strip material clamped by the two pairs of the clamping devices and vertically moving the strip conveying device to a shelter position where is an exterior of a circle area formed by turning the strip material.

In order to resolve the above subject, in the inspection method for inspecting a front surface and a back surface of a strip material according to one of the tenth present invention through the fourteenth present invention, the inspection method according to the fifteenth present invention is characterized of applying tensile stress to the strip material by a tensile stress measurement device provided at least one of the two pairs of the clamping devices and controlling a pressing amount of the pressing device(s) so as to equal tensile stress measured by the tensile stress measurement device to tensile stress previously determined.

In order to resolve the above subject, in the inspection method for inspecting a front surface and a back surface of a strip material according to one of the tenth present invention through the fifteenth present invention, the inspection method according to the sixteenth present invention is characterized of forming a desirable warped shape at a front end of the strip material by the pressing device(s), wherein the pressing device(s) is arranged at an outlet with respect to the strip material conveyed through the two pairs of the clamping devices.

In order to resolve the above subject, in the inspection method for inspecting a front surface and a back surface of a strip material according to the tenth present invention through the sixteenth present invention, the inspection method according to the seventeenth present invention is characterized of applying tensile stress to the strip material before clamping the both ends of the strip material by the two pairs of the clamping devices.

Effect of the Invention

According to the present invention, a structure of an inspection device can be simplified and a pressing device can be down sized so that it is possible to provide an excellent inspection device for inspecting front and back surfaces of the strip material in view of an economic reason.

Further, tensile stress can be set with high accuracy and tensile stress variation with respect to an amount of the tensile stress set in an inspection process for inspecting front and back surfaces of the strip material can be minimized so that it is possible to provide a safety inspection device for inspecting the front and back surfaces of the strip material with high reliability.

Further, it is possible to provide an inspection device for inspecting front and back surfaces of the strip material wherein a warp of the strip material along a width direction of the strip material is adjusted and wrinkles occurred by clamping the strip material by the clamping devices can be controlled.

FIG. **4*a*** shows an outline of the best-mode of an embodiment of an inlet side clamping devices according to the present invention from a view point at an inlet side of the strip material wherein the inlet side clamping devices are amounted on an inlet rotation frame.

FIG. **4*b*** shows an outline of the best-mode of an embodiment of an outlet side clamping devices according to the present invention from a view point at an outlet side of the strip material wherein the outlet side claims devices are amounted on an outlet rotation frame.

Figure 5:
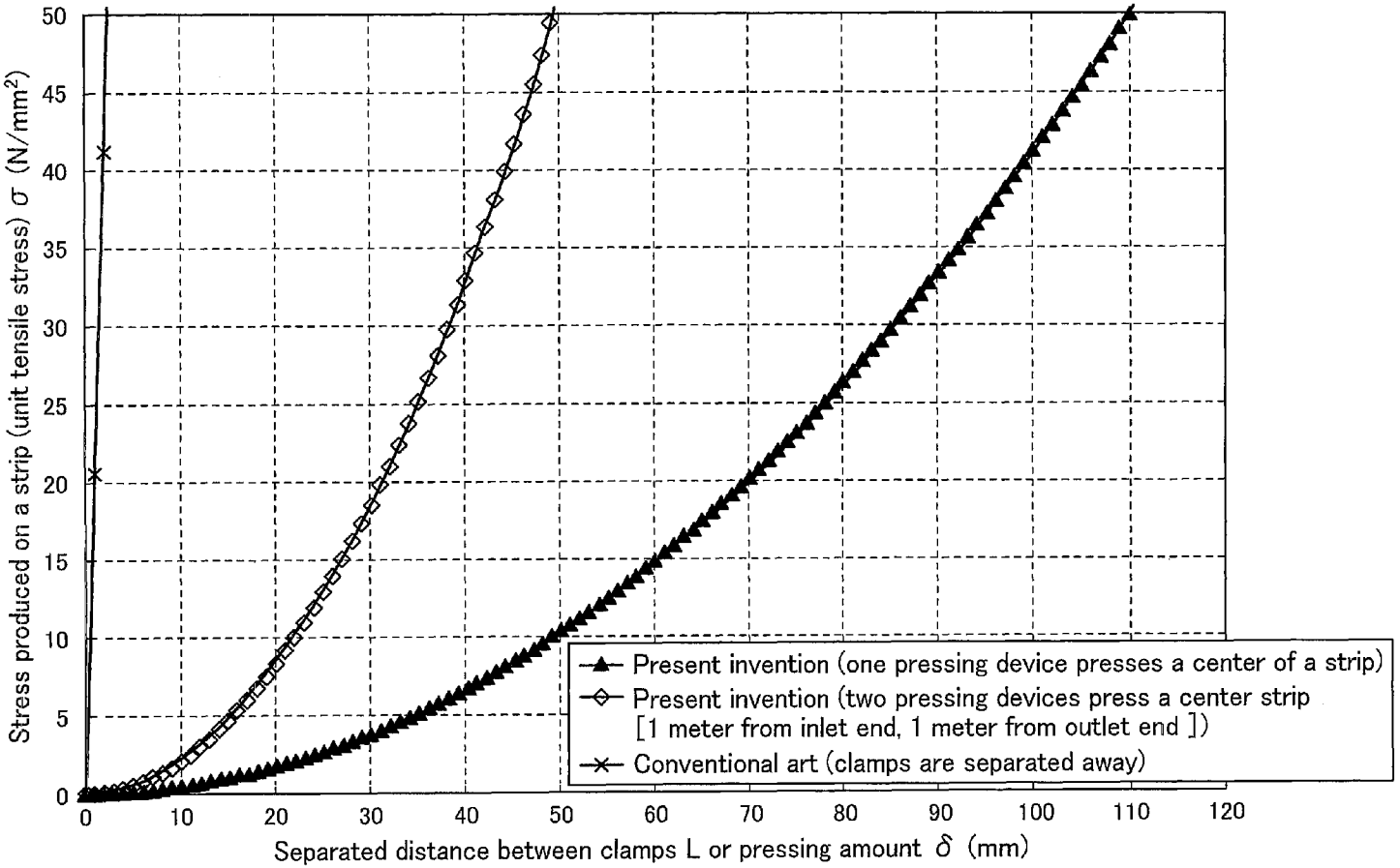

FIG. 5 is a graph for comparing an amount of tensile stress applied to a strip material in the present invention and that in a conventional art.

Figure 6:
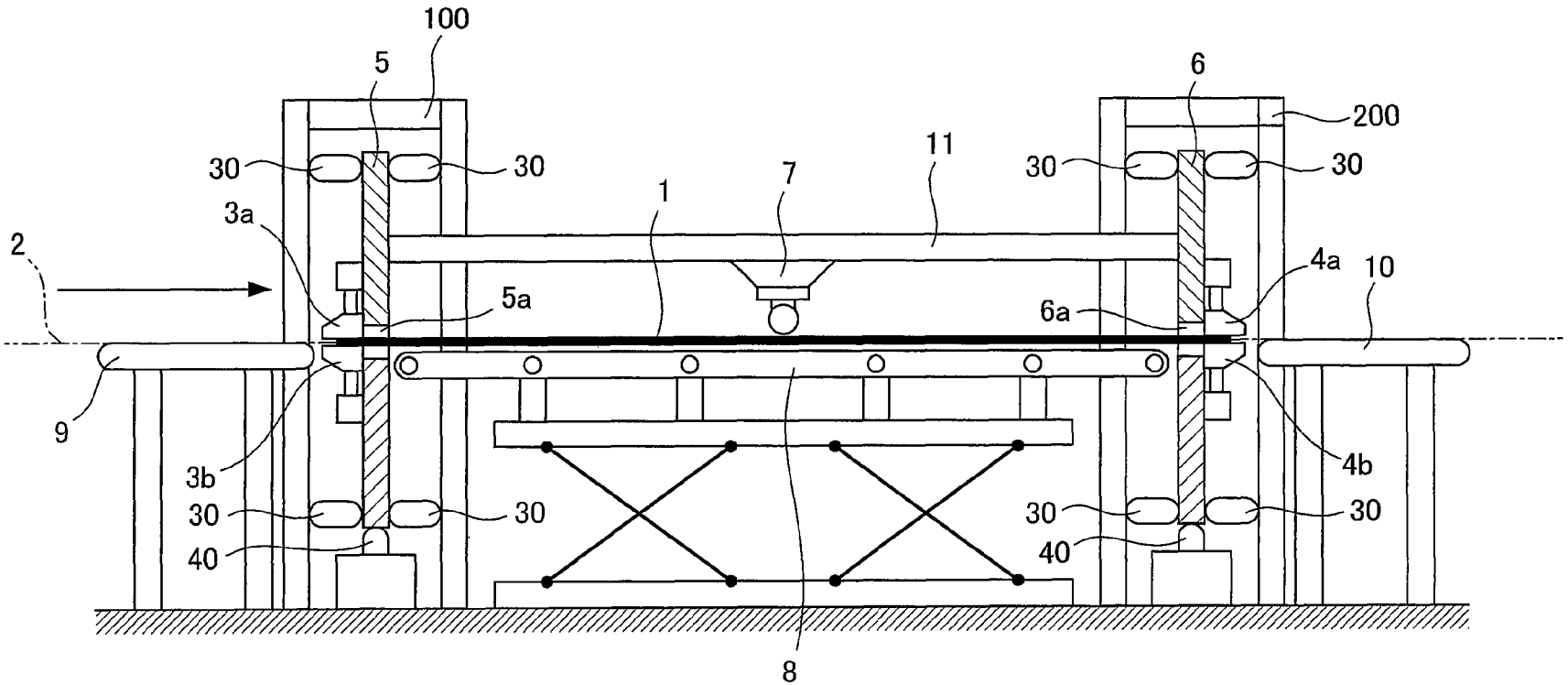

FIG. 6 shows an outline of an embodiment of a device for inspecting a strip material according to the present invention wherein the device is mounted at a center portion of a pressing machine.

Figure 7:
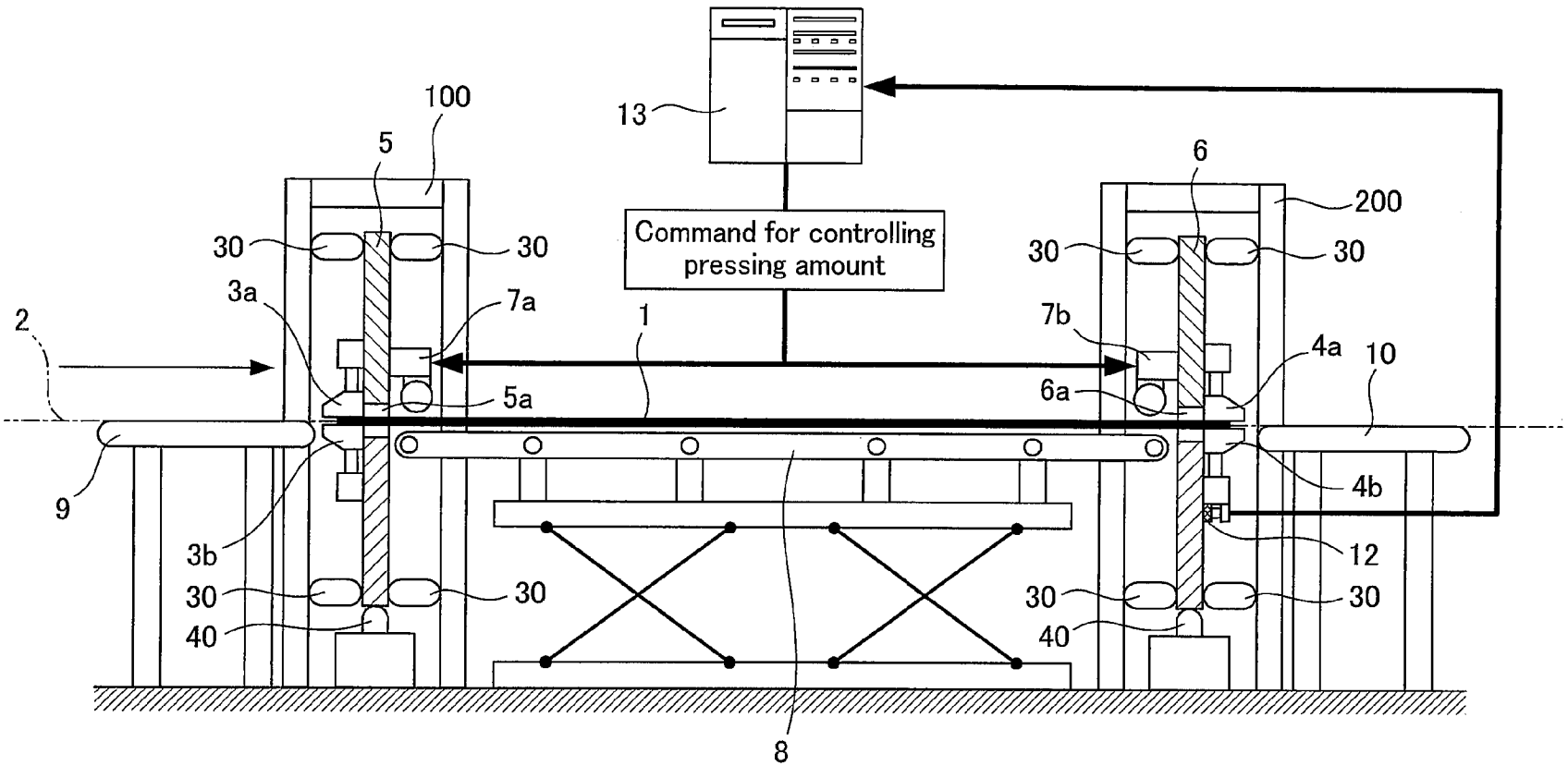

FIG. 7 shows an outline of an embodiment of a device for inspecting a strip material according to the present invention wherein the device is mounted at a tensile stress measurement device and a control device.

Figure 8:
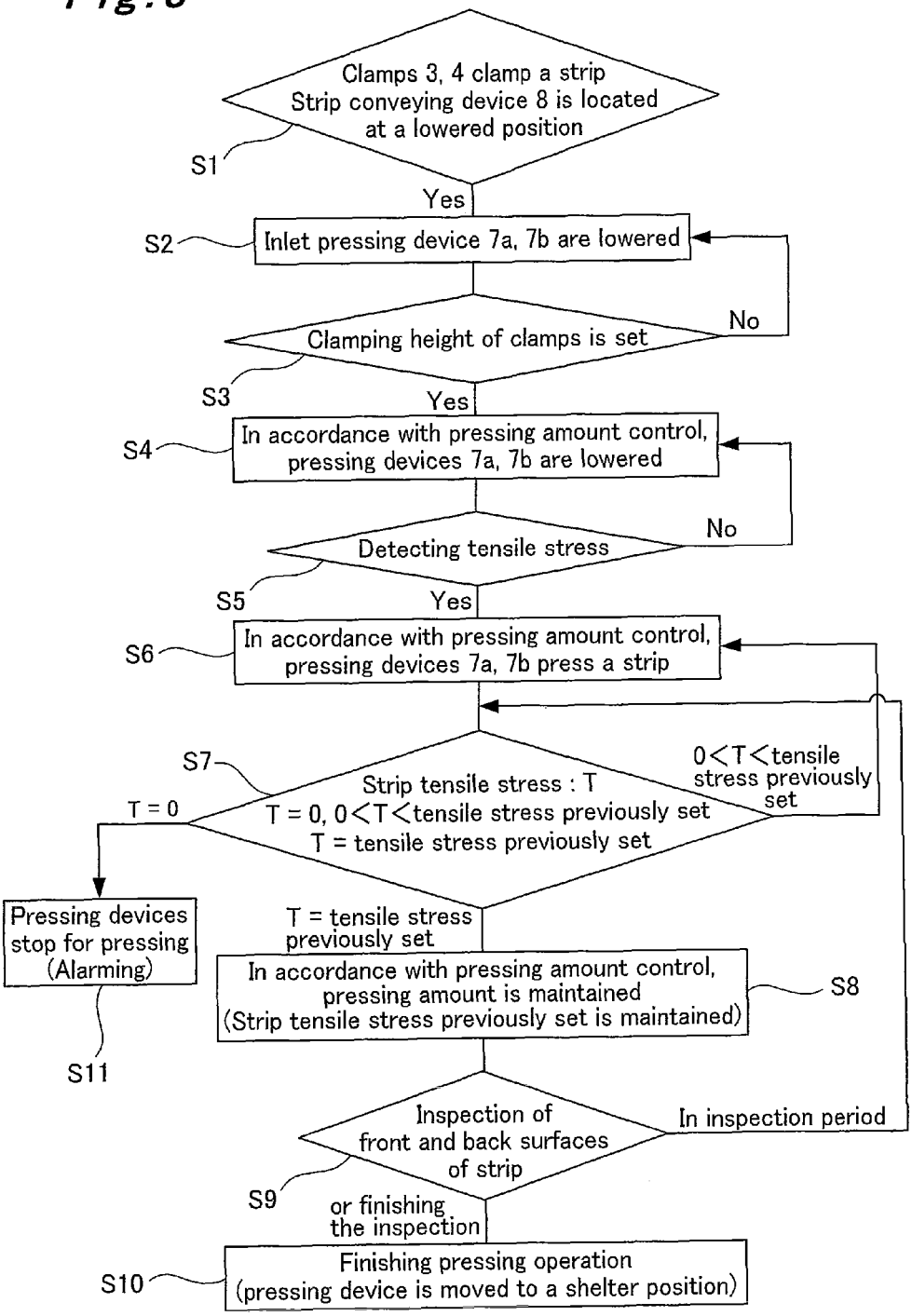

FIG. 8 is a flow chart for showing how a pressing amount of the pressing machine is controlled by the device for inspecting a strip material.

Figure 9:
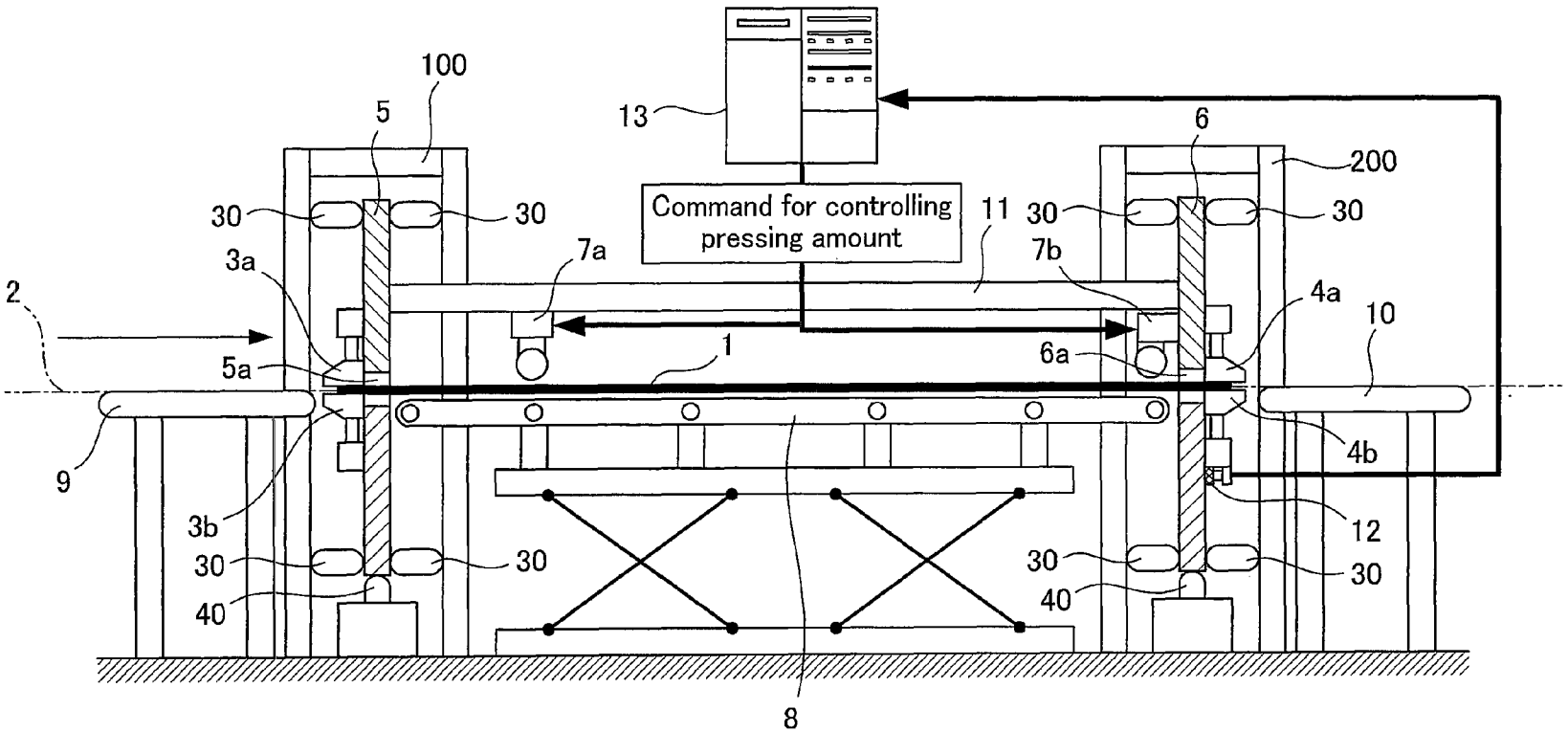

FIG. 9 is an outline of an embodiment of a device for inspecting a strip material according to the present invention wherein two pressing devices is provided at an inlet side and an outlet side, respectively.

Figure 10:
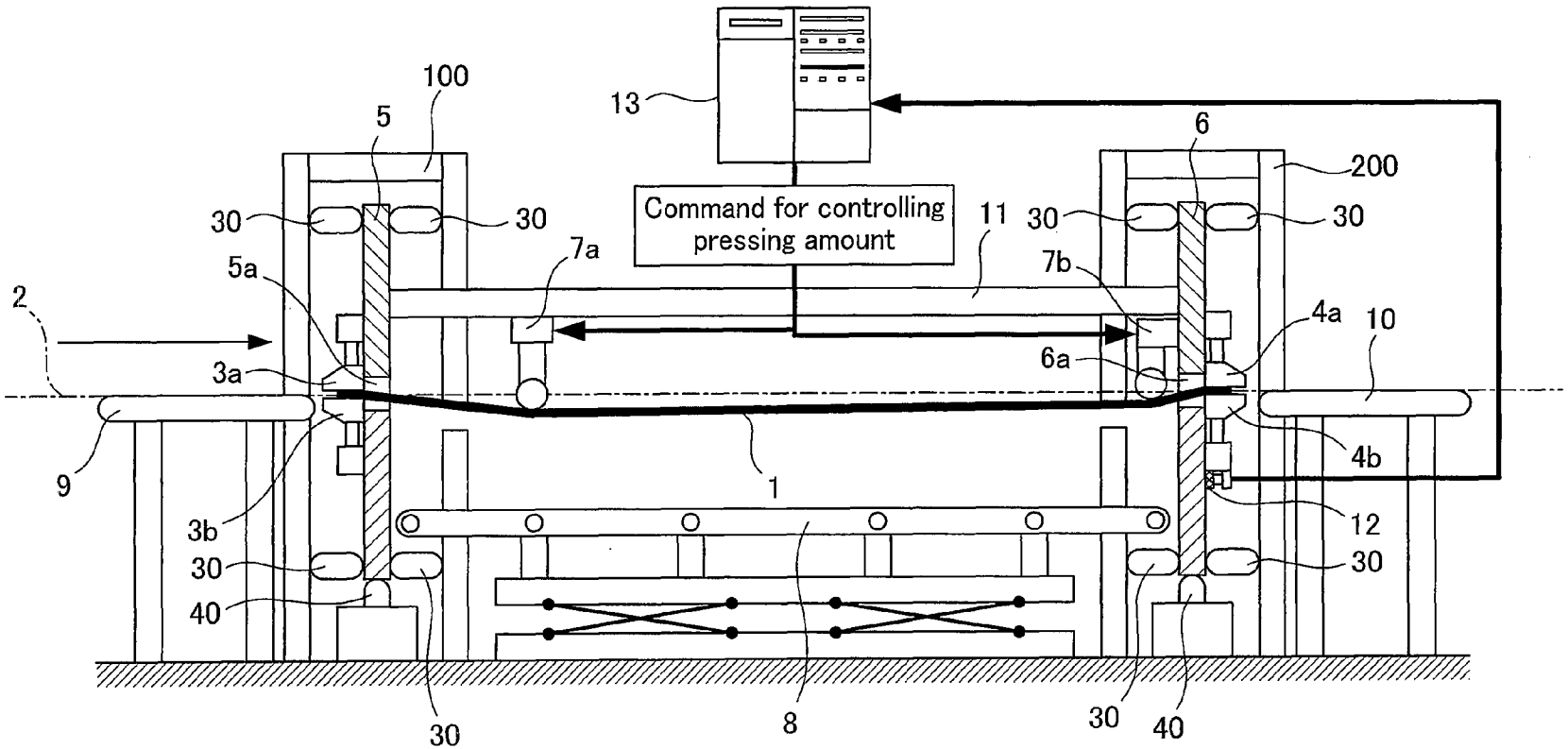

FIG. 10 is an outline of an embodiment of a device for inspecting a strip material according to the present invention wherein two pressing devices is provided at an inlet side and an outlet side, respectively and tensile stress is applied to the strip material at an inlet side and a warp is provided at a front end of the strip material.

Figure 11:
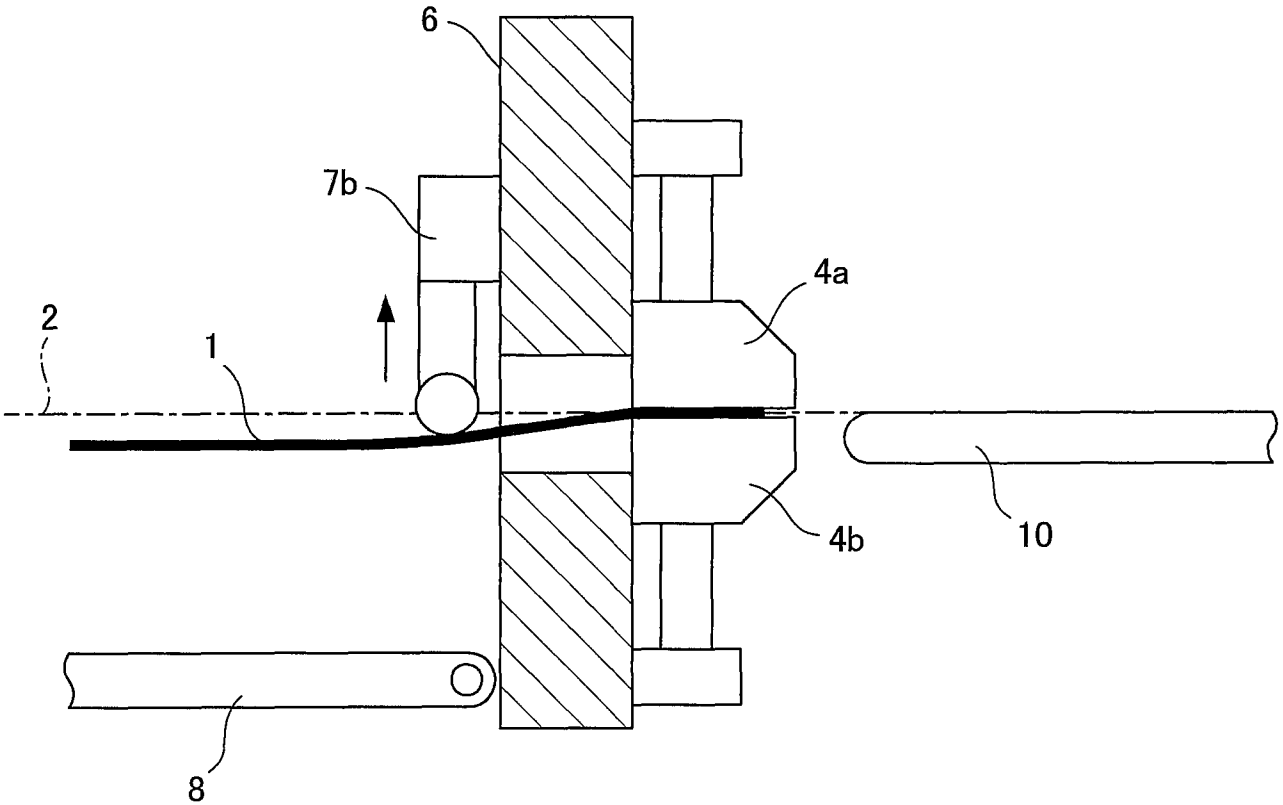

FIG. 11 shows an outline of an embodiment of a device for inspecting a strip material wherein the pressing device applies tensile force so as to provide a warp at the front end of the strip material.

Figure 12:
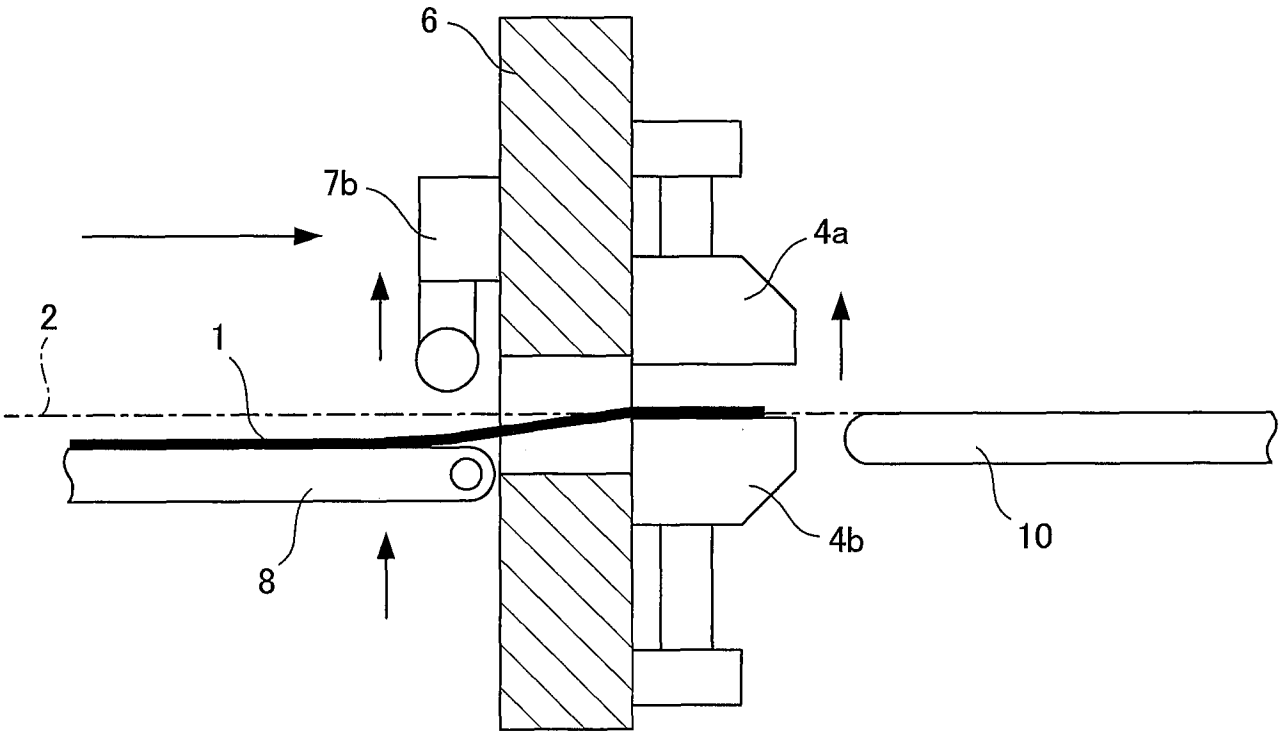

FIG. 12 shows an outline of an embodiment of a device for inspecting a strip material according to the present invention wherein the pressing device provided at an outlet side is moved to a shelter position after the pressing device providing a warp at the front end of the strip material.

Figure 13:
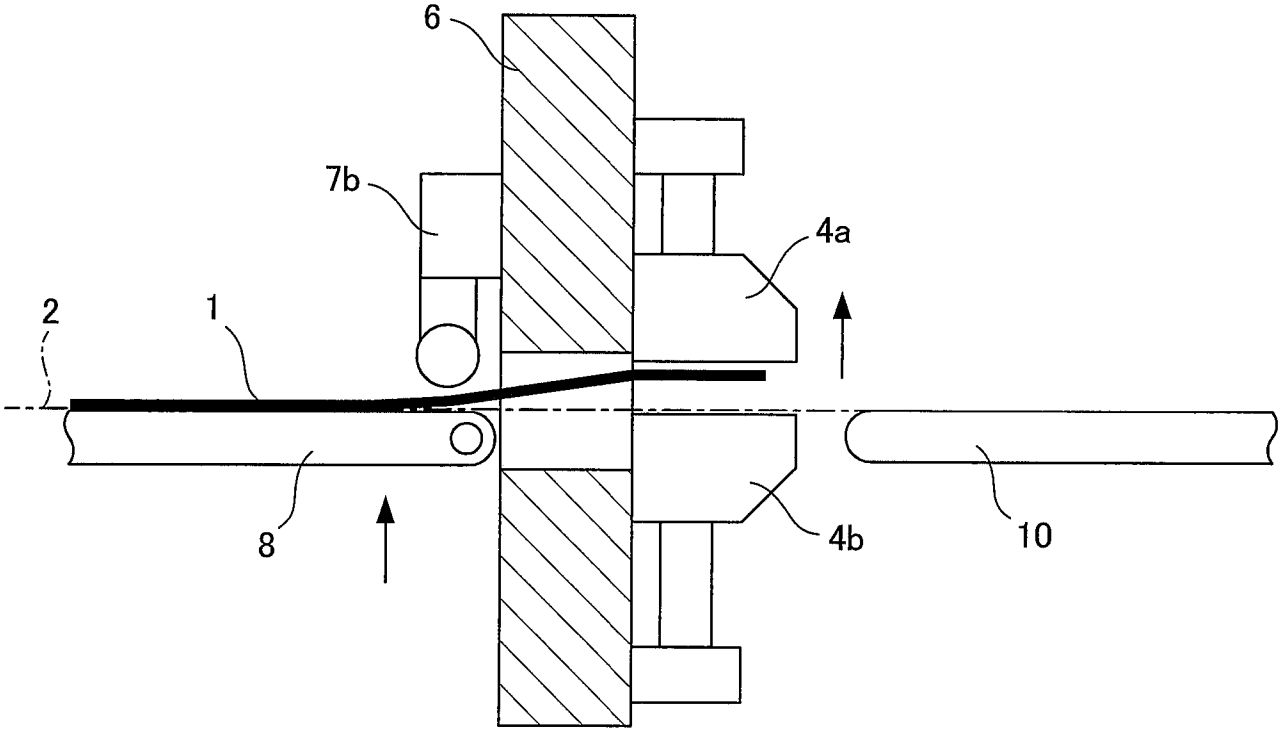

FIG. 13 shows an outline of an embodiment of a device for inspecting a strip material according to the present invention, wherein a device for conveying the strip material is vertically moved to a level of a clamping position after the pressing device providing a warp at the front end of the strip material.

Figure 14:
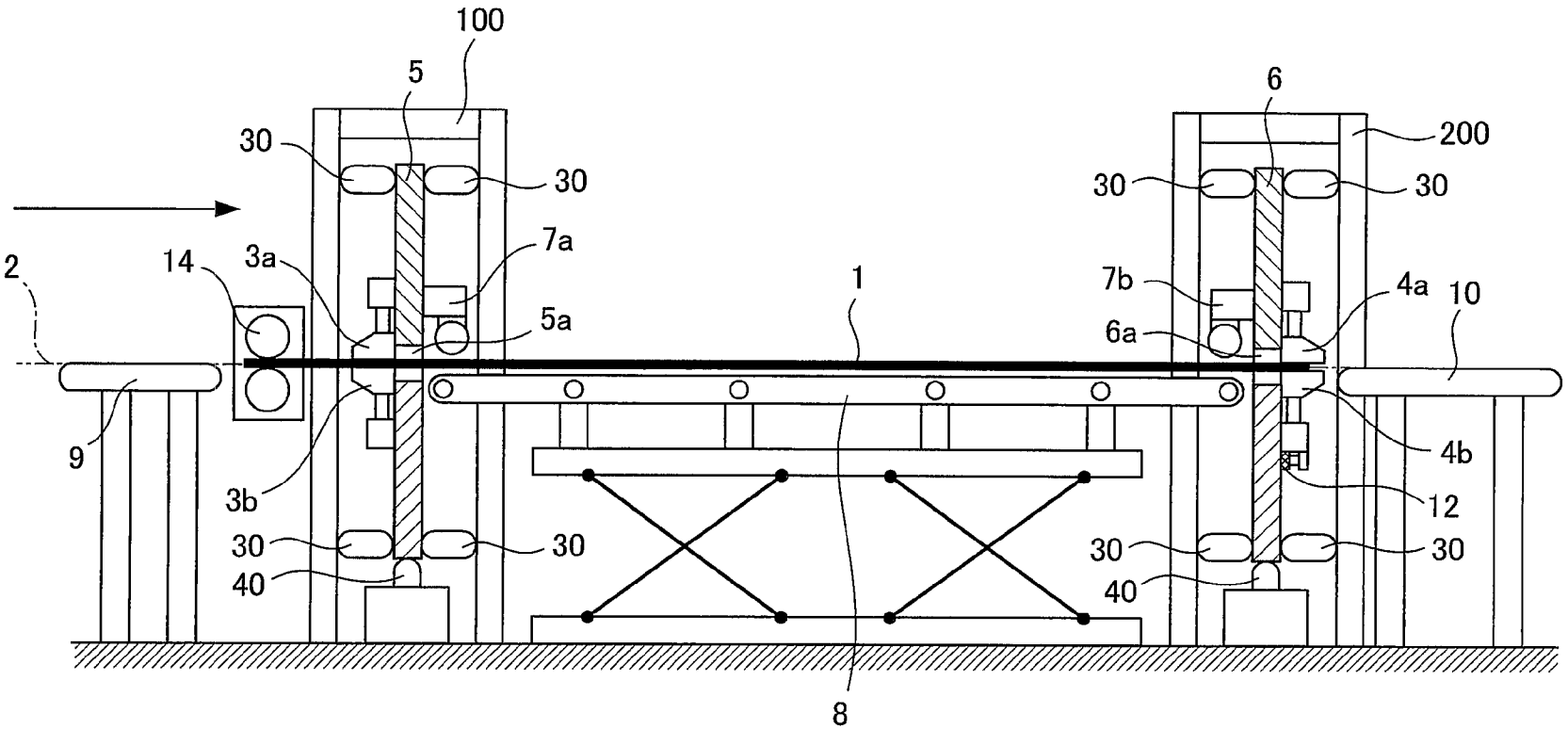

FIG. 14 shows an outline of the best-mode of an embodiment of a device for inspecting a strip material according the present invention, wherein a device for providing a tensile stress before clamping the strip material by the clamping devices.

BEST EMBODIMENT OF THE PRESENT INVENTION

An inspection device according to the present invention and a method thereof will be described hereinafter.

In a device for inspecting front and back surfaces of a strip material rolled by a rolling apparatus, wherein the both ends of the strip material along a longitudinal direction are clamped by two pairs of clamping devices, respectively, a warp of the strip material along a width direction thereof can be adjusted and wrinkles occurred by being clamped by clamping devices can be controlled while a front surface or a back surface of the strip material are pressed at an optional position between the two pairs of the clamping devices.

In a method for inspecting front and back surfaces of a strip material rolled by a rolling device, a structure of an inspection device can be simplified by providing at least one pressing device mounted at an optional position between two pairs of clamping machines for pressing a front surface or a back surface of a strip material after clamping the both ends of a strip material along a longitudinal direction with the two pairs of clamping devices and additionally applying tensile stress to the strip material by displacing the two pairs of the clamping devices along the longitudinal direction of the strip material after turning the strip material around a central portion along a width direction of the strip material or a position near to the central portion as a rotational axis with an optional degree while the clamping devices clamp the strip material.

Further, by turning the strip material at an optional angle, a honing process and an optical inspection process for judging whether harmful defects or designs are existed or not are easily operated.

Before clamping the both ends of the strip material along the longitudinal direction of thereof by the two pairs of clamping devices, a strip material conveying device that is vertically movable is provided between the two pairs of the clamping devices and arranged at a clamping level of the clamping devices. Thus, a distance between the clamping devices is minimized and a slack amount of the strip material can be controlled. A fluctuation amount of the strip material at a moment when the strip material is rotated can be reduced. Before rotating the two pairs of the clamping devices and the strip material, the strip material conveying device is moved to a shelter position. Therefore, the device having a separating function and a rotating function in an inspection process can be operated in a compact space.

At least one pair of the two pairs of the clamping devices comprises a tensile stress measurement device. At least one pressing device controls a pressing amount for pressing a front surface of a back surface of the strip material so as to set a strip tensile stress as a previous set tensile stress measured by a measurement device so that a tensile stress applied to the strip material is accurately controlled to the previous set value and maintain it at the level and an abnormal condition such as the strip material being broken can be detected in accordance with a measured tensile stress.

The pressing device mounted at an outlet side forms a desired warp shape at the front end of the strip material so that the strip material can be conveyed stably after inspecting the strip material.

Tensile stress is applied to a strip material before the two pairs of the clamping devices clamp the both ends of the strip material along the longitudinal direction at a height as same as the previous determined level of the clamping material, a strip distance between the clamping devices can be minimized when the clamping devices clamp the strip material. Thus, a fluctuation amount of the strip material cause by rotating the strip material clamped with the clamping devices can be controlled.

Embodiment 1

An embodiment according to the present invention will be described with reference to accompanying drawings. Hereinafter, although the present invention is described as an embodiment of a cool rolling apparatus, the utility of the present invention is not restricted to the cool rolling apparatus.

A method for inspecting front and back surfaces of a rolled strip material according to the present invention will be described with reference to FIG. 1 through FIG. 4.

Figure 1:
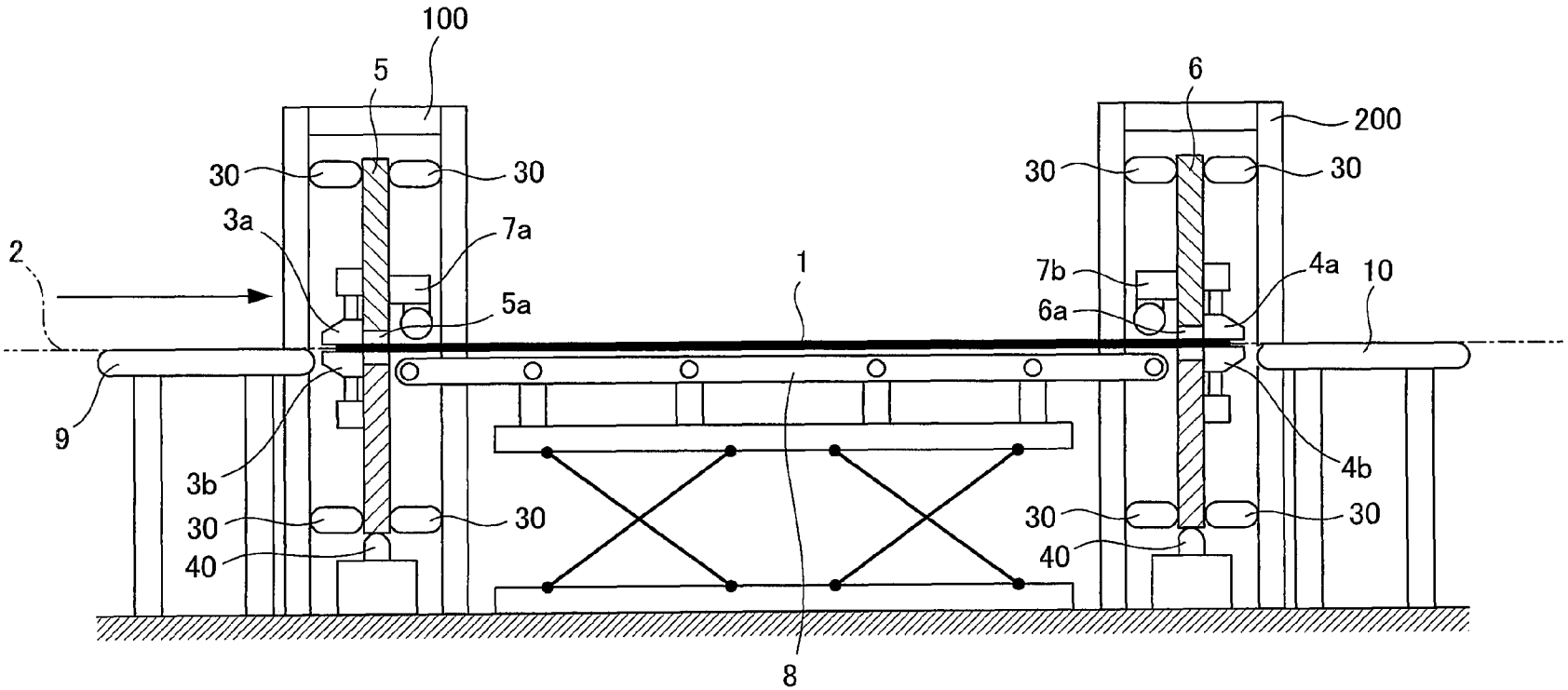
FIG. 1 shows an outline of the best-mode of an embodiment of a device of inspecting a strip material according to the present invention.

FIG. 1 shows an outline of a device for inspecting a rolled strip material according to the present invention.

As shown in FIG. 1, an upper stream stand 100 and a down stream stand 200 are provided. An interval distance between the upper stream 100 and the down stream 200 is as similar as a distance of a strip material 1 rolled and cutout in a rolling apparatus. A conveying device 8 for conveying a strip material is provided between the upper stream stand 100 and the down stream stand 200 and the conveying device 8 can be moved upwardly/downwardly. Further, an inlet conveying table 9 is provided at an upper stream side with respect to the upper streams stand 100 and an outlet conveying table 10 is provided at a downstream side with respect to the down stream stand 200.

At the upper stand 100, a disc shaped inlet rotational frame 5 is pivotally supported on two supporting rollers 400. A slit 5*a* is provided at the disc shaped inlet rotational frame 5 and a strip material is passed through the slit 5*a*.

A plurality of control rollers 30 are provided for allowing a rotation of the inlet rotational frame 5 and preventing the inlet rotational frame 5 being moved along the longitudinal direction of the strip material.

Figure 4A:
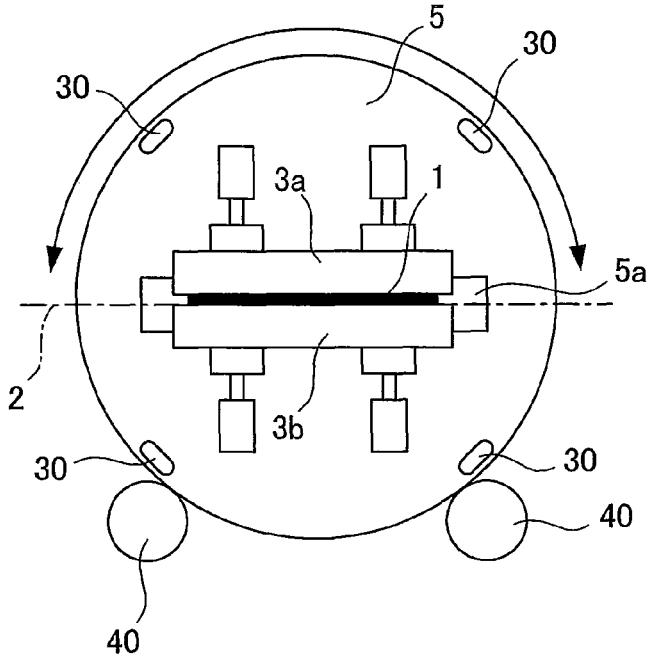

As shown in FIG. 4(A), at an inlet side of the inlet rotational frame 5, one pair of inlet clamping devices 3*a*, 3*b* is provided at an upper side and a lower side with respect to the slit 5, respectively.

The clamping devices 3*a*, 3*b* clamp the strip material 1 by clamping a tail portion of the strip material from an upper side and a lower side of the strip material. The both devices may be movable in a vertical direction with respect to the inlet rotational frame 5. At least one of the clamping devices may be movable in a vertical direction with respect to the inlet rotational frame 5 and the other may be fixed with respect to the inlet rotational frame.

In an embodiment as described below, an upper inlet clamping device 3*a* is movable and a lower inlet clamping device 3*b* is fixed.

Figure 4B:
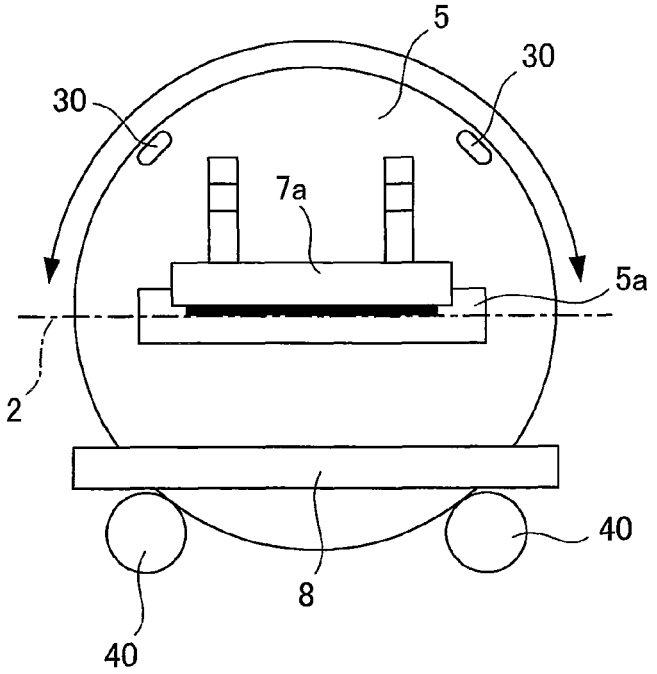

As shown in FIG. 4(B), at an outlet side of the inlet rotational frame 5, an inlet depressing device 7*a* is adapted to a portion above the slit 5*a*.

The inlet depressing device 7*a* is movable in a vertical direction with respect to the inlet rotational frame 5 and presses the strip material 1 so as to produce a tensile stress on the strip material 1.

On the other hand, at the down stream stand 200, a disc shaped outlet rotational frame 6 is pivotally supported on two supporting rollers 40. A slit 6*a* through that a strip material is conveyed is provided at the outlet rotational frame 6. A plurality of control rollers 30 are provided for allowing a rotation of the outlet rotational frame 6 and preventing the outlet rotational frame 6 being moved along the longitudinal direction of the strip material.

At an outlet side of the inlet rotational frame 6, one pair of inlet clamping devices 4*a*, 4*b* is provided at an upper side and a lower side with respect to the slit 6*a*, respectively.

The inlet clamping devices 4*a*, 4*b* clamp the strip material 1 by clamping a front portion of the strip material 1 from an upper side and a lower side of the strip material. The both devices may be movable in a vertical direction with respect to the outlet rotational frame 6. At least one of the clamping devices may be movable in a vertical direction with respect to the outlet rotational frame 6 and the other may be fixed with respect to the outlet rotational frame 6.

In an embodiment as described below, an upper outlet clamping device 4*a* is movable and a lower outlet clamping device 4*b* is fixed.

At an inlet side of the outlet rotational frame 6, an outlet depressing device 7*b* is adapted to a portion above the slit 6*a*.

The outlet pressing device 7*b* is movable in a vertical direction with respect to the outlet rotational frame 6 and presses down the strip material 1 so as to produce a tensile stress on the strip material 1.

The inlet rotational frame 5 and the outlet rotational frame 6 are electrically synchronized and rotated. However, as shown in FIG. 6, in order to rotate the frames 5 and 6 synchronically in a mechanical relation, the both frames 5 and 6 may be connected with a separator 11.

Further, as shown in FIG. 6, the separator 11 for connecting the inlet rotational frame 5 and the outlet rotational frame 6 may comprise a pressing device 7 having a capability as same as the pressing devices 7*a* and 7*b*. The separator 11 has a function as a frame on which the pressing frame is attached in addition to mechanically synchronize the inlet rotational frame 5 and the outlet rotational frame 6 so as to rotate together. The pressing device 7 is optionally mounted at a position between the inlet and outlet clamping devices 3*a*, 3*b*, 4*a* and 4*b*.

In order to inspect front and back surfaces of a strip material 1 optically, a rolled strip material 1 is cutout as a section having a sufficient length of several meters to about 15 meters by a shear (not shown) at an outlet side of a cool rolling machine. As shown in an arrow in the drawing, the cut section is conveyed to the inlet conveying table 9 and passed through released inlet clamping devices 3*a* and 3*b* and a front end of the strip material 1 is passed on the strip conveying device 8 lifted up to a clamping level 2 of the inlet and outlet clamping devices 3*a*, 3*b*, 4*a* and 4*b* (as shown as a dashed line in the drawing) so as to feed the strip material to the released outlet clamping devices 4*a* and 4*b*.

After the tail end of the strip material 1 arriving at the released inlet clamping devices 3*a* and 3*b*, the tail end of the strip material 1 is clamed by the inlet clamping devices 3*a* and 3*b*. Then, the front end of the strip material 1 is clamped by the outlet clamping devices 4*a* and 4*b*.

Before the front end of the strip material along the longitudinal direction thereof clamped by the outlet clamping devices 4*a* and 4*b*, the strip conveying device 8 is lifted up to the clamping level 2 of the inlet and outlet clamping devices 3*a*, 3*b*, 4*a* and 4*b* so that a warp amount of the strip material 1 can be minimized. By reducing the warp amount of the strip material while the two pairs of the inlet and outlet clamping devices 3*a*, 3*b*, 4*a* and 4*b* are rotated, a fluctuation amount of the strip material 1 at a moment when the strip material 1 is rotated is reduced so that the device can be improved in view of a safety point. FIG. 1 shows an outline of a furnished condition that the strip material 1 is clamped by the two pairs of the inlet and outlet clamping devices 3*a*, 3*b*, 4*a* and 4*b*.

Figure 2:
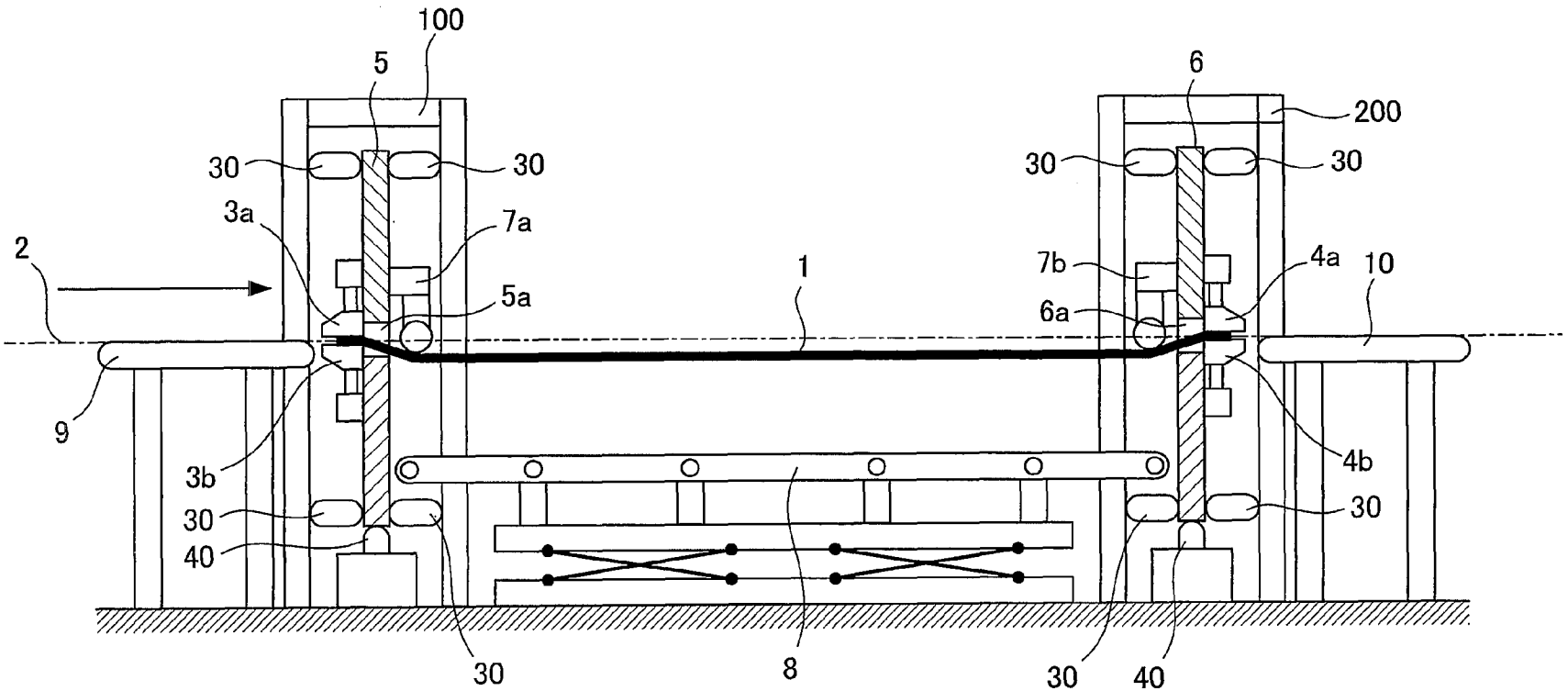
FIG. 2 shows an outline of the best-mode of an embodiment of a device of inspecting a strip material according to the present invention during a rolling operation.

After clamping the strip material 1 with the two pairs of the clamping devices 3*a*, 3*b*, 4*a* and 4*b*, as shown in FIG. 2, the strip material conveying device 8 that is lifted up to the clamping level 2 of the inlet and outlet clamping devices 3*a*, 3*b*, 4*a* and 4*b* is lowered to a shelter position. Thereby, the inlet and outlet pressing devices 7*a* and 7*b* do not press the strip material 1 onto the strip material conveying device 8 so that it becomes possible not to contact the inlet and outlet pressing devices 7*a* and 7*b* with the strip material conveying device 8 while the inlet and outlet pressing devices 7*a* and 7*b* are rotated. After furnishing a downward movement of the strip material conveying device 8, the inlet and outlet pressing devices 7*a* and 7*b* press down the strip material 1 so as to apply a tensile stress to the strip material of which a tensile stress is increased to a tensile stress previously set.

After increasing the tensile stress applied to the strip material 1 to the predetermined level and furnishing a pressing process of the inlet and outlet pressing devices 7*a* and 7*b*, a honing process is operated to a first inspected surface of the strip material 1 and to inspect the first inspected surface optically.

The inlet and outlet pressing devices 7*a* and 7*b* for pressing a surface of the strip material may comprise a roller type contact portion for contacting with the surface of the strip material for preventing the surface of the strip material from being damaged.

In the case that a warp along a width direction of the strip material 1 and wrinkles caused by clamping the strip material by the inlet and outlet clamping devices 3*a*, 3*b*, 4*a* and 4*b* are occurred, such a warp can be adjusted and such as wrinkles can be dismissed by applying a tensile stress to the strip material 1. Thus, an optical inspection can be operated to an inspected surface of the strip material 1 without any problems.

FIG. 2 shows an outline of a condition that the inlet and outlet pressing devices 7*a* and 7*b* press the strip material 1 so as to increase a tensile stress produced in the strip material to the predetermined level after lowering the strip conveying device 8 to the shelter position.

Figure 3:
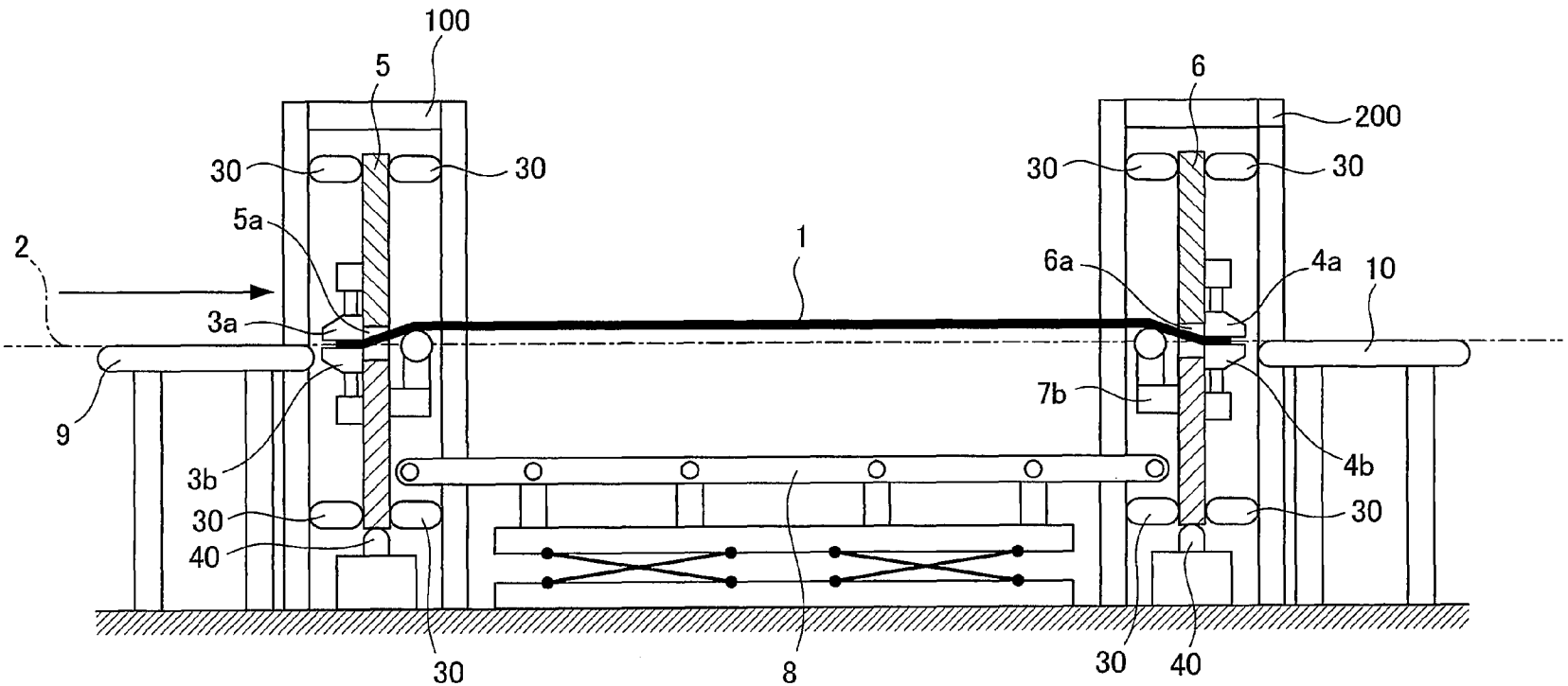
FIG. 3 shows an outline of the best-mode of an embodiment of a device of inspecting a strip material according to the present invention in a condition that the strip material is turned about 180 degree.

In the next, as shown in FIG. 3, while the predetermined tensile stress is applied to the strip material clamped by the inlet and outlet clamping devices 7*a* and 7*b* is maintained, the inlet rotational frame 5 and the outlet rotational frame 6 are mechanically synchronized and rotated by 180 angular degree around a central point of the strip material along a width direction of the strip material with the clamping devices 3*a*, 3*b*, 4*a* and 4*b* or a point near the central point as a rotational axial in order to inspect a second surface on which a honing process is operated of the strip material 1 optically.

By inclining an inspected surface of the strip material with respect to a horizontal line at an optional angle, harmful defect or design on the front and back surfaces of the strip material can be easily detected.

FIG. 3 shows an outline that the inlet rotational frame 5 and the outlet rotational frame 6 are electrically synchronized and rotated around an central point of the strip material along a width direction with the clamping devices 3*a*, 3*b*, 4*a* and 4*b* or a point near the central point as a rotational axis while a tensile stress applied to the strip material 7 by the inlet and outlet pressing devices 7*a* and 7*b* is maintained at the predetermined level.

Accordingly, as shown in the best mode of the embodiment according to the present invention, in a method for inspecting front and back surfaces of a strip material rolled by a rolling apparatus, at least one of the pressing devices 7, 7*a* and 7*b* presses a front surface or a back surface of a strip material at an optional portion between the two pairs of the clamping devices 3*a*, 3*b*, 4*a* and 4*b* after clamping the both ends of the strip material along a longitudinal direction thereof with the two pairs of the clamping devices 3*a*, 3*b*, 4*a* and 4*b*. By rotating the strip material clamped with the two pairs of the clamping materials 3*a*, 3*b*, 4*a* and 4*b* around a central point of the strip material along a width direction thereof or a point near the central point as an rotational axis at an optional angular degree, the strip material is not displaced by clamping the strip material along the longitudinal direction thereof with the two pairs of the inlet and outlet clamping devices 3*a*, 3*b*, 4*a* and 4*b*. A function for providing a tensile stress is separately provided in addition to a clamping function so that an inspection apparatus can be simplified and the pressing devices 7, 7*a* and 7*b* are down sized. It becomes possible to provide a device for excellently inspecting front and back surfaces of a strip material in view of an economic point.

A warp along the width direction of the strip material is adjusted and wrinkles occurred at points clamped by the clamping devices 3*a*, 3*b*, 4*a* and 4*b* are controlled so that inspected surfaces of the strip material 1 can be easily inspected.

In addition to effects as described above, a warp amount of the strip material can be minimized by minimizing a distance of the strip material between the two pairs of inlet and outlet clamping devices 3*a*, 3*b*, 4*a* and 4*b* while the strip conveying device 8 is substantially lifted to a clamping level 2 of the inlet and outlet clamping devices 3*a*, 3*b*, 4*a* and 4*b*. A stability of the strip material 1 after turning the strip material 1 one time can be improved by reducing the fluctuation amount of the strip amount rotated with the two pairs of inlet and outlet clamping devices 3*a*, 3*b*, 4*a* and 4*b*.

By providing the pressing devices 7, 7*a* and 7*b* above the clamping level 2 of the inlet and outlet clamping devices 3*a*, 3*b*, 4*a* and 4*b*, that is, providing the pressing devices 7, 7*a* and 7*b* opposite to an arrangement of the strip conveying device 8, the strip conveying device 8 provided between the two pairs of the inlet and outlet clamping devices 3*a*, 3*b*, 4*a* and 4*b* has a sufficient total length so that a stability of a strip material conveying performance can be improved and an operating efficiency thereof can be increased, since the strip conveying device 8 and the pressing devices 7, 7*a* and 7*b* are prevented from being contacted each other.

In the next, an effect of the invention that a function for providing a tensile stress and a function for clamping a strip material are individually prepared will be described with reference to FIG. 5. FIG. 5 shows a stress σ caused by strain in a strip material [unit tensile stress applied to a strip material] in a conventional method for applying a tensile stress to a strip by separating two pairs of clamping devices (Patent Document 2) and a present invention method for applying a tensile stress to a strip material by pressing a surface of the strip material by pressing at least one of pressing devices at an optional position between two pairs of clamping devices.

In order to make a clear a difference between the conventional method and the present invention method, tensile stress, that is, unit tensile stress caused by an extension of a strip material clamped by two pairs of clamping devices those are separately provided and an depression force of the pressing device is calculated and compared, respectively. An equation for calculating the tensile stress σ (unit tensile stress applied to a strip material) is $\sigma=(\Delta L/L)\times E$, wherein E is Young module, ΔL is an extended amount of a strip material and L is a distance between the clamping devices. In the conventional method for separating the two pairs of the clamping devices, the extended amount of the strip material (ΔL) is calculated by a separated distance between the two pairs of the clamping devices. In the present invention method for pressing the strip material by the pressing device, the extended amount of the strip material (ΔL) is calculated by a pressing amount.

In an inspecting process, an operator has to approach a position beside a strip material in order to operate a honing process, tensile stress set at the strip material is too large. The strip material has to be treated carefully not to be broken. Therefore, a tensile stress applied to the strip material has to be set with high accuracy.

A tensile stress applied to front and back surfaces of a rolled strip material is from about 10 $N/mm^2$ to about 50 $N/mm^2$ in an inspection time. Depending on a thickness of the strip material, an amount of the tensile stress is determined.

In the conventional method for applying a tensile stress to a strip by separating two pairs of clamping devices, for example, a tensile stress of about 10 $N/mm^2$ (tensile stress per unit) is produced by being away a distance of 0.5 mm in the case that a distance between the clamping devices is 10 m. That is, if a range of the tensile stress is set from 10 $N/mm^2$ to 50 $N/mm^2$, a distance for being away the clamping devices is from 0.5 mm to 2.5 mm. It is a very fine range. Accordingly, the accuracy for positioning the clamping devices in the conventional method for being away the two pairs of the clamping devices is about 0.1 mm, that is, a displacement amount of a tensile stress per unit has to be set about 2 $N/mm^2$.

In the case that a distance between the clamping devices is 10 m and a separation accuracy of 0.1 mm is maintained at a double structure device having a separating function and a rotational function, it is required to employ parts having high accuracy and high rigidity. If a mechanical system is deteriorated by using for a long time, it is difficult to keep the set tensile stress constantly. If a strip material is sagged and a slack is manually adjusted by separating the clamping devices, a tensile stress is too large in a honing process at an inspecting time. Therefore, a risk that a strip material is broken is increased. There is a serious problem in view of a safety point.

On the other hand, in the best mode of an embodiment according to the present invention, inlet and outlet pressing devices 7*a* and 7*b* is provided at an inlet rotational frame 5 and an outlet rotational frame 6, respectively and the pressing devices press the strip material at a position between the two pairs of the clamping devices, if a position of the both pressing machines is separated 1 meter from the respective clamping devices, a separation distance may be set from about 20 mm to about 50 mm in the case that an amount of the pressing force is from 10 $N/mm^2$ to about 50 $N/mm^2$. Even if the separation distance is displaced 1 mm, the maximum variation of the pressing force is 2 $N/mm^2$. Therefore, a risk that the strip material is broken in an inspection time can be reduced. Accuracy for setting a pressing position is enough satisfied so as to set a tensile stress at a high accuracy.

In FIG. 1 to FIG. 3, a separator 1 is unnecessary so that an operation efficiency for inspecting a strip material from naked eyes can be improved and a total weight of the apparatus and a total cost of the apparatus can be reduced.

Further, as shown in FIG. 6, in the case that the pressing device 7 presses a central portion between the clamping devices, Further, as shown in FIG. 6, in the case that the pressing device 7 press a central portion between the clamping devices, a pressing amount is within in a range from about 50 mm to about 110 mm if the tensile stress is within a range from about 10 $N/mm^2$ to about 50 $N/mm^2$. That is, the range is relatively large. Even if the pressing amount is varied 1 mm, the maximum displacement of the tensile stress is 1 $N/mm^2$. An accuracy for setting the pressing amount can be sufficiently obtained so that it is possible to provide a tensile stress setting device having high Robust characteristic that is capable of setting tensile stress with high accuracy.

A distance between adjacent fulcrums becomes about a half so that an effect for adjusting a warp of a strip material along a width direction of the strip material can be improved.

Further, in the method according to the present invention, even if a mechanical system of the device is deteriorated after using the device for a long time, tensile stress a applied to a strip material [unit tensile stress] is only varied with in a range of ±several $N/mm^2$ in the case that an error displacement of the pressing amount is several mm. A varied tensile stress is not so influenced to a tensile stress previously set so that a risk that the strip material is broken can be reduced.

In accordance with the present invention, two pairs of inlet and outlet clamping devices 3*a*, 3*b*, 4*a* and 4*b* are not displaced along a longitudinal direction. A function for setting tensile stress applied to a strip material and a function for clamping the strip material are individually provided so that the tensile stress can be set with high accuracy and a tensile stress variation with respect to a tensile stress amount previously set in a process for inspecting front and back surfaces of the strip material can be minimized. Thus, a risk that the strip material is broken can be reduced and an inspection device can be simplified. It is possible to provide a safety inspection device for inspecting front and back surfaces of the strip material with high reliability.

With reference to a control outline and a pressing method as shown in FIG. 7 and FIG. 8, it will be described how a tensile stress applied to a strip material is controlled to equal to a tensile stress previously set in the case that at lease one pressing device presses on a surface of the strip material.

The tensile stress previously set for inspecting front and back surfaces of a strip material is within a range from about 10 $N/mm^2$ to about 50 $N/mm^2$ as described above. The tensile stress previously set is determined in accordance with a thickness and a width direction of the strip material.

As pressing devices for pressing a surface of a strip material as shown in FIG. 7, an inlet pressing device 7*a* is arranged between a pair of inlet clamping devices 3*aq* and 3*b* and an outlet pressing device 7*b* is arranged between a pair of outlet clamping devices 4*a* and 4*b*. A tensile stress measurement device 12 is attached to the outlet clamping devices 4*a* and 4*b*. A pressing amount control device 13 outputs a command for controlling pressing amount to the inlet pressing device 7*a* and the outlet pressing device 7*b* in order that a tensile stress amount measured by the tensile stress measurement device 12 is equal to the tensile stress previously set. A method for measuring a tensile stress applied to a strip material 1 may be measured by the tensile stress measurement device 12 attached to the outlet clamping devices 4*a* and 4*b*, a method for calculating a pressing force or a pressing amount of the pressing device 7.

A tensile stress applied to the strip material 1 is controlled in accordance with a flow chart as shown in FIG. 8.

The both ends of a strip material 1 along a longitudinal direction is claimed by a pair of inlet clamping devices 3*a* and 3*b* and a pair of outlet clamping devices 4*a* and 4*b*, respectively and a downward movement of a strip conveying device 8 is accomplished (step S1), pressing devices 7*a* and 7*b* are lowered to a clamping level 2 of the inlet and outlet clamping devices 3*a*, 3*b*, 4*a* and 4*b* (step S2). After setting the inlet and outlet clamping devices 3*a*, 3*b*, 4*a* and 4*b* at the clamping level 2, that is, the strip material 1 is vertically moved while the strip material is clamped by the inlet and outlet clamping devices 3*a*, 3*b*, 4*a* and 4*b* (step S3). The strip material 1 is pressed by lowering the pressing devices 7*a* and 7*b* until a tensile stress is detected by a tensile stress measurement device 12 of which a pressing force is controlled (step S4). After detecting the tensile stress (S5), the pressing devices 7*a* and 7*b* control a pressing amount so as to maintain a tensile stress applied to the strip material at a predetermined level (steps S7 and S8). After furnishing a detection of front and back surfaces of the strip material (step S10), the pressing devices is controlled (step S6).

In a control process for controlling a pressing amount after setting the pressing devices 7*a* and 7*b* at the clamping level 2 of the inlet and outlet clamping devices 3*a*, 3*b*, 4*a* and 4*b*, a tensile stress applied to the strip material measured by the tensile stress measurement device 12 is always feed back to a pressing amount control device 13 so as to control the pressing amount. A tensile stress is set with high accuracy and a displacement of a tensile stress at an inspection time for inspecting the front and back surfaces of a strip material can be minimized so that a tensile stress setting condition inspected through naked eyes can be maintained at a constant level. Therefore, it can be provided an inspection device for detecting front and back surfaces of a strip material with high reliability. By maintaining an amount of the tensile stress at the constant level, a risk that the strip material is broken can be reduced and the safety of the device can be improved.

Further, in the case that a tensile stress measurement device 12 detects a measured tensile stress applied to a strip material as zero in a step for setting a tensile stress of a strip material applied by the pressing devices 72 and 7*b*, the device 12 judges whether the clamping devices 3*a*, 3*b*, 4*a* and 4*b* clamp improperly and/or a strip material is broken. Then, the pressing devices 7*a* and 7*b* stop on pressing and the pressing amount control device 13 outputs alarming (step S11). Thereby, the inspection device is protected and an abnormal condition can be detected so that the inspection device for inspecting front and back surfaces of a strip material can be provided with a high safety and a high reliability.

In the case that at least two pressing devices are provided and one pressing device is arranged at a position beside a pair of inlet clamping devices and another is arranged at a position beside a pair of outlet clamping devices, the pressing device arranged at the position beside the pair of the outlet clamping devices controls a pressing amount pressed from a clamping level of the clamping devices that is computed for forming a desirable warped shape with respect to the strip material and the pressing device arranged at the position beside the pair of inlet clamping devices control a pressing amount so as to equal a tensile stress measured by a tensile stress measurement device with a tensile stress previously set. An arrangement of those devices and a pressing method thereof will be described with reference to FIG. 9 to FIG. 13. FIG. 9 shows an outline that an outlet pressing device 7*b* is attached to an outlet rotational frame 6 and an inlet pressing device 7*a* is attached to a separator 11.

FIG. 10 shows an outline that the outlet pressing device 7*b* presses a strip material so as to warp the strip material with a desirable degree (a front end of the strip material is slightly curved toward an upper direction) and the inlet pressing device 7*a* applies a desirable tensile stress to the strip material.

In the conventional inspection device, when a strip material 1 is carried out after finishing the inspection process (the strip material 1 is conveyed from a space among the inlet and outlet clamping devices 3*a*, 3*b*, 4*a* and 4*b*), a front end of the strip material 1 is sticking with an outlet conveying table 10 arranged at a downstream side with respect to the inspection device. Due to an inconvenient in view of transporting the strip material, an operation efficiency of the inspection device is lowered.

In order to avoid such a trouble for conveying the strip material 1, a pressing amount control device 13 computes an pressing amount of an outlet pressing device 7*b* judging from a clamping level 2 so as to deform a front end of the strip material 1 at a desirable warp shape. In accordance with the calculation, the strip material 1 is pressed by the outlet pressing device 7*b* arranged at a position near the outlet clamping devices 4*a* and 4*b* so as to warp the strip material 1.

A pressing amount of the outlet pressing device 7*b* for warping a strip material in a desirable shape is calculated in accordance with a distance between the outlet pressing device 7*b* and the outlet clamping devices 4*a* and 4*b*, a mechanical characteristic, a thickness and a width of the strip material 1.

FIG. 11 is an outline that a desirable warp is provided to a front end of the strip material 1.

As shown in FIG. 12, in order to carry out the strip material 1 having the desirable warped shape, the outlet pressing device 7*b* is lifted up to a shelter position and then the strip conveying device 8 is lifted up to a height for clamping a strip material 1 (that is lower than the clamping level 2). In the next, after releasing the clamping device 4*a*, 4*b*, as shown in FIG. 13, the strip conveying device 8 is lifted up to the clamping level 2 and the inlet clamping devices 3*a* and 3*b* so as to begin carrying out the strip material 1. The front end of the strip material is warped in the desirable shape, so that the strip material 1 can be carried out without any conveying trouble, that is, the strip material is stopped caused by sticking. The operative efficiency of the device is improved.

FIG. 13 shows a condition at a time immediately before carrying out the strip material 1.

If the outlet pressing device 7*b* is moved upwardly to an upper shelter position before releasing the outlet clamping devices 4*a* and 4*b* and then the strip conveying device 8 is lifted up to the clamping level 2, the warped shape of the front end of the strip material 1 is returned to an original shape. Therefore, it has to be avoiding for such a phenomenon.

As described above, a desirable warped shape is provided at a front end of a strip material by the outlet pressing device 7*b* and a desirable tensile stress is applied to the strip material 1 by inlet clamping device 72 so that a function for setting a tensile stress and a function for setting a warped shape are individually provided. The inlet pressing device 7*a* for providing a tensile stress and the outlet pressing device 7*b* for providing a warped shape are separately existed so that each pressing amount is varied depending on the respective desirable tensile stress and the respective desirable warp degree.

Although the inlet pressing device 7*a* is attached to the separator 11 as shown in FIG. 9 and FIG. 10, the inlet pressing device 7*a* may be attached to the inlet rotational frame 5. Likewise, although the outlet pressing device 7*b* is attached to the outlet rotational frame 6, the outlet pressing device 7*b* may be attached to the separator 11.

In the next, with reference to FIG. 14, an arrangement and a method according to the present invention will be described, wherein the both ends of the strip material along the longitudinal direction are clamped by inlet and outlet clamping devices 3*a*, 3*b*, 4*a* and 4*b* at a clamping level 2 and a device for applying tensile stress to the strip material is arranged.

In order to apply tensile stress to a strip material in the case that the both ends of the strip material along the longitudinal direction are clamped by two pairs of the clamping devices 3*a*, 3*b*, 4*a* and 4*b*, a tensile stress producing device 14 is provided at an inlet side with respect to the inlet clamping devices 3*a* and 3*b*. The tensile stress producing devices 14 may employ a method for applying tensile by utilizing a tangential force of a pinch roller, a method for being away the clamping devices 4*a* and 4*b* for clamping the strip material and the other various methods.

A tensile stress producing device 14 may be arranged at an outlet side with respect to the outlet clamping devices 4*a* and 4*b* or each tensile stress producing devices 14 is provided at an inlet side and an outlet side of the outlet clamping devices 4*a* and 4*b*.

In order to inspect front surface and back surfaces of a rolled strip material optically, the rolled material is cut by a shearing machine provided at an outlet side of a cool rolling apparatus (not shown) and a length of a cut section is from several meter to about 15 m. The cut section, that is, a strip material has a necessary and sufficient length to be optically inspected as the strip material 1. The strip material 1 is passed on an inlet conveying table 9 and through the tensile stress producing device and the inlet clamping devices 3*a* and 3*b* those are released. Then, a front end of the strip material 1 is passed through the strip conveying device 8 lifted up to the clamping level 2 and arrived at the outlet clamping devices 4*a* and 4*b* those are released. After arriving the front end of the strip material 1 at the outlet clamping devices 4*a* and 4*b*, the front end of the strip material is clamped by the outlet clamping devices 4*a* and 4*b*. Tensile stress is applied to the strip material 1 by the tensile stress producing device 14 arranged at an inlet side with respect to the inlet clamping devices 3*a* and 3*b*. While the tensile stress is applied to the strip material 1, a rear end of the strip material 1 is clamped by the inlet clamping devices 3*a* and 3*b* and the strip conveying device 8 is lowered and the inlet and outlet pressing devices 7*a* and 7*b* press the strip material 1. Thereby, a warp amount of the strip material 1 at a moment before pressed by the pressing devices 7*a* and 7*b* can be minimized and a fluctuation of the strip material at a moment when the two pairs of the clamping devices 3*a*, 3*b*, 4*a* and 4*b* are rotated can be controlled so that the strip material can be inspected from an optional angle.

Accordingly, the following effect of the present invention is obtained.

In an inspection device for inspecting front and back surfaces of a strip material rolled by a rolling machine, the both ends of the strip material along the longitudinal direction are clamped by two pairs of clamping devices and the front surface or the back surface of the strip material is pressed at an optional position between the two pairs of the clamping devices. The two pairs of the clamping devices adjust a warp of the strip material 1 along a width direction thereof and wrinkles occurred at the case that the strip material 1 of which a length is from several meter to about 15 m is clamped by the clamping devices is prevented so that the strip material 1 is inspected easily.

In addition to the effect as described above, there is another effect as described below. In an inspection method for inspecting front and back surfaces of a strip material rolled by a rolling machine, the both ends of the strip material along the longitudinal direction are clamped by the two pairs of the clamping devices and then at least one pressing device presses the front surface or the back surface of the strip material at an optional position between the two pairs of the clamping devices and the strip material clamped by the clamping devices is turned around a center point of the strip material along a width direction thereof or a portion near the center point as a rotational axis at an optional angular degree. Thus, after clamping the strip material, the clamping devices are not structurally displaced with respect to the longitudinal axis of the strip material. A function for providing a tensile stress and a function for clamping the strip material are individually and separately provided so that the inspection device can be simplified and at least one depression device can be down sized by pressing the strip material at a point between the two pairs of the clamping devices. It is superior in view of an economical point.

In addition to the effect as described above, there is another effect as described below. A strip conveying device that is moved vertically is provided at a position between the two pairs of the clamping devices. Before clamping the both ends of the strip material along the longitudinal direction thereof by the two pairs of the clamping devices, the strip material conveying device vertically movable sets a strip material at a clamping level of the clamping devices. Thereby, a length of the strip material along the longitudinal direction between the clamping devices can be minimized and a sagging amount of the strip material is controlled so that a fluctuation amount of the strip material at a moment when the strip material is rotated with the clamping device can be reduced. Thus, the strip material can be rotated more safety. Before rotating the strip material with the two clamping devices, the strip material conveying device is moved to a shelter position where is an exterior side with respect to a circle formed by a rotational radius of the strip material so that a function for conveying a sheet material and a function for rotating a strip material in an inspection operation can be provided at a compact space. A construction cost of the device can be saved.

At least one of the two pairs of the clamping devices comprises a tensile stress measurement device at one pair of the clamping devices. The tensile stress measurement device measures a tensile stress applied to the strip material. In order to become the measured tensile stress at a desired level, at least one pressing device that presses a front surface or a back surface of the strip material controls a pressing amount. Thereby, the desired level of the tensile force applied to the strip material is set with high accuracy so that the accuracy for setting tensile stress is improved, a risk that a strip material is broken at an inspection operation can be reduced and the device is operated more safety. The tensile stress measurement device can detect an abnormal condition, it is possible to provide an inspection device for inspecting front and back surfaces of a strip material with a high reliability and safeness.

In addition to the effect as described above, there is another effect as described below. At least two pressing devices are positioned between the two pairs of the clamping devices. The two pressing devices is arranged at an inlet side and an outlet side, respectively. The pressing device arranged at the outlet side presses a strip material under a control that a pressing amount is applied from a computed clamping height of the clamping devices so as to deform the strip material to a desirable warped shape. The pressing device arranged at the inlet side presses the strip material under a control that the tensile stress measurement device can measure a desirable tensile stress. Thereby, a warped degree of a front end of a strip material along a feeding direction that is important to convey the strip material after inspecting the strip material, can be adjusted by the outlet pressing device. A strip material can be conveyed with high reliability and an efficiency of the inspection operation is improved and a risk that the strip material is broken at an inspection operation is reduced. The inspection device can be operated more safety.

In addition to the effect as described above, there is another effect as described below. Before clamping the both ends of a strip material along the longitudinal direction thereof with the two pairs of the clamping devices at a set clamping level of the clamping devices, tensile stress is applied to the strip material so that a distance of the strip material between the clamping devices can be minimized so that a fluctuation amount of the strip material at a moment when the strip material is rotated with the two pairs of the clamping devices is controlled. The strip material can be rotated stably and the device operates safety.

What is claimed is:

1. An inspection device for inspecting a front surface and a back surface of a strip material rolled by a rolling machine, the inspection device for inspecting the front surface and the back surface of the strip material characterized of comprising:

two pairs of clamping devices for clamping the both ends of the strip material along a longitudinal direction of the strip material, respectively, and fixed such that the clamping devices are not movable along the longitudinal direction of the strip material, and rotating said strip material around a central point of said strip material along a width direction of said strip material or a point near said central point as a rotational axis at an optional angular degree and at least one pressing device for pressing the front surface or the back surface of said strip material at optional positions between said two pairs of said clamping devices, wherein said strip material is hold at said optional angular degree.

2. An inspection device for inspecting a front surface and a back surface of a strip material as claimed in claim 1, the inspection device characterized in that said clamping devices and said pressing device are attached to rotational frames for rotating said strip material around a central point of said strip material along said width direction or a point near said central point as an rotational axis at an optional angular degree, respectively.

3. An inspection device for inspecting a front surface and a back surface of a strip material as claimed in claim 1, said inspection device characterized of comprising a strip material conveying device between said two pairs of said clamping devices and said strip material conveying device for conveying said strip material along said longitudinal direction at a level that said strip material are clamped by said two pairs of said clamping devices.

4. An inspection device for inspecting a front surface and a back surface of a strip material as claimed in claim 3, said inspection device characterized in that said strip material conveying device is vertically movable.

5. An inspection device for inspecting a front surface and a back surface of a strip material as claimed in claim 1, said inspection device characterized in that at least one of said two pair of said clamping devices comprise a tensile stress measurement device and a control device for controlling a pressing amount of said pressing device so as to equal a tensile stress measured by said tensile stress measurement device to a tensile stress previously set.

6. An inspection device for inspecting front surface and a back surface of a strip material as claimed in claim 1, said inspection device characterized in that said pressing device is arranged at an outlet side with respect to said two pairs of said clamping devices for clamping said strip material between that said strip material is conveyed and said pressing device applied a desirable warped shape with respect to said front end of said strip material.

7. In an inspection method for inspecting a front surface and a back surface of a strip material as claimed in claim 6, said inspection method characterized of conveying said strip material along said longitudinal direction, wherein a strip conveying device is arranged between said two pairs of said clamping devices and said strip material is conveyed at a height as same as a level of said strip material clamped by said clamping devices.

8. In an inspection method for inspecting a front surface and a back surface of a strip material as claimed in claim 7, said inspection method characterized of turning said strip material clamped by said two pairs of said clamping devices and vertically moving said strip conveying device to a shelter position where is an exterior of a circle area formed by turning the strip material.

9. In an inspection method for inspecting a front surface and a back surface of a strip material as claimed in claim 6, said inspection method characterized of applying tensile stress to said strip material by a tensile stress measurement device provided at least one of said two pairs of said clamping devices and controlling a pressing amount of said pressing device so as to equal tensile stress measured by said tensile stress measurement device to tensile stress previously determined.

10. An inspection device for inspecting front surface and a back surface of a strip material as claimed in claim 1, said inspection device characterized of comprising a tensile stress producing device for applying tensile stress to said strip material of which said both ends along said longitudinal direction are clamped by said two pairs of said clamping devices.

11. In an inspection method for inspecting a front surface and a back surface of a strip material rolled by a rolling machine, said inspection method for inspecting said front surface and said back surface of said strip material characterized of comprising:

pressing said front surface of said strip material by at least one pressing device, wherein both ends of said strip material are clamped by two pairs of clamping devices, which are fixed such that the clamping devices are not movable along a longitudinal direction of the strip material, and at least said one pressing device is provided at an optional position between said two pairs of said clamping devices and inspecting said front surface or said back surface of said strip material and turning said strip material around a central point of said strip material along a width direction or a point near said central point as an rotational axis at an optional angular axis so as to inspect said front surface or said back surface of said strip material.

12. In an inspection method for inspecting a front surface and a back surface of a strip material as claimed in claim 11, said inspection method characterized of forming a desirable warped shape at a front end of said strip material by said pressing device, wherein said pressing device is arranged at an outlet with respect to said strip material conveyed through said two pairs of said clamping devices.

13. In an inspection method for inspecting a front surface and a back surface of a strip material as claimed in claim 11, said inspection method characterized of applying tensile stress to said strip material before clamping said both ends of the strip material by said two pairs of said clamping devices.

* * * * *